United States Patent [19]

Hall, Jr. et al.

[11] Patent Number: 4,542,675

[45] Date of Patent: Sep. 24, 1985

[54] AUTOMATIC TEMPO SET

[76] Inventors: Robert J. Hall, Jr., 20756 Tribune St., Chatsworth, Calif. 91311; George R. Hall, 13613 Huston St., Sherman Oaks, Calif. 91423; Jack C. Cookerly, 26916 Barbacoa Pl., Saugus, Calif. 91350

[21] Appl. No.: 463,125

[22] Filed: Feb. 4, 1983

[51] Int. Cl.[4] ..... G10H 1/40

[52] U.S. Cl. ..... 84/1.03; 84/DIG. 12

[58] Field of Search ..... 84/1.03, DIG. 12

[56] References Cited

U.S. PATENT DOCUMENTS

| | | | |
|---|---|---|---|
| 4,089,245 | 5/1978 | Dietrich | 84/1.03 |
| 4,163,407 | 8/1979 | Solender | 84/1.03 |
| 4,186,639 | 2/1980 | Robinson et al. | 84/1.03 |
| 4,242,936 | 1/1981 | Swain | 84/1.03 |
| 4,345,501 | 8/1982 | Nakada et al. | 84/1.03 |
| 4,361,066 | 11/1982 | Jones | 84/1.03 |
| 4,402,244 | 9/1983 | Nakada et al. | 84/1.03 |
| 4,432,266 | 2/1984 | Nakada | 84/1.03 |

*Primary Examiner*—Stanley J. Witkowski

*Attorney, Agent, or Firm*—Nilsson, Robbins, Dalgarn, Berliner, Carson & Wurst

[57] ABSTRACT

Musical accompaniment is provided in different musical styles to the playing of an instrument, upon selection of one of the styles. A preferred tempo rate, or a range of acceptable tempo rates, are provided in response to selection of the musical style, causing the accompaniment to be sounded at or near a musically correct tempo in all cases. In one embodiment, a preferred tempo rate and a range of acceptable deviation from that rate are provided for each style, causing the accompaniment to be played at the preferred rate unless altered within the acceptable range by a performer.

21 Claims, 23 Drawing Figures

OSCILLATOR
HARMONIC SPECTRUM ADJUSTER
ENVELOPE GENERATOR
MODULATOR
TEMPO CLOCK
TEMPO DEVIATION
GENERAL PURPOSE RAM
PROGRAM ROM
ORCHESTRATION & INSTRUMENT ROM
MICRO-PROCESSOR
LATCH
COUPLING NETWORK
ELECTRONIC ORGAN CIRCUITRY
BOSSA NOVA
BIG BAND
BARO QUE
JAZZ GUITAR
CONTEMPORARY GUITAR & CELLI

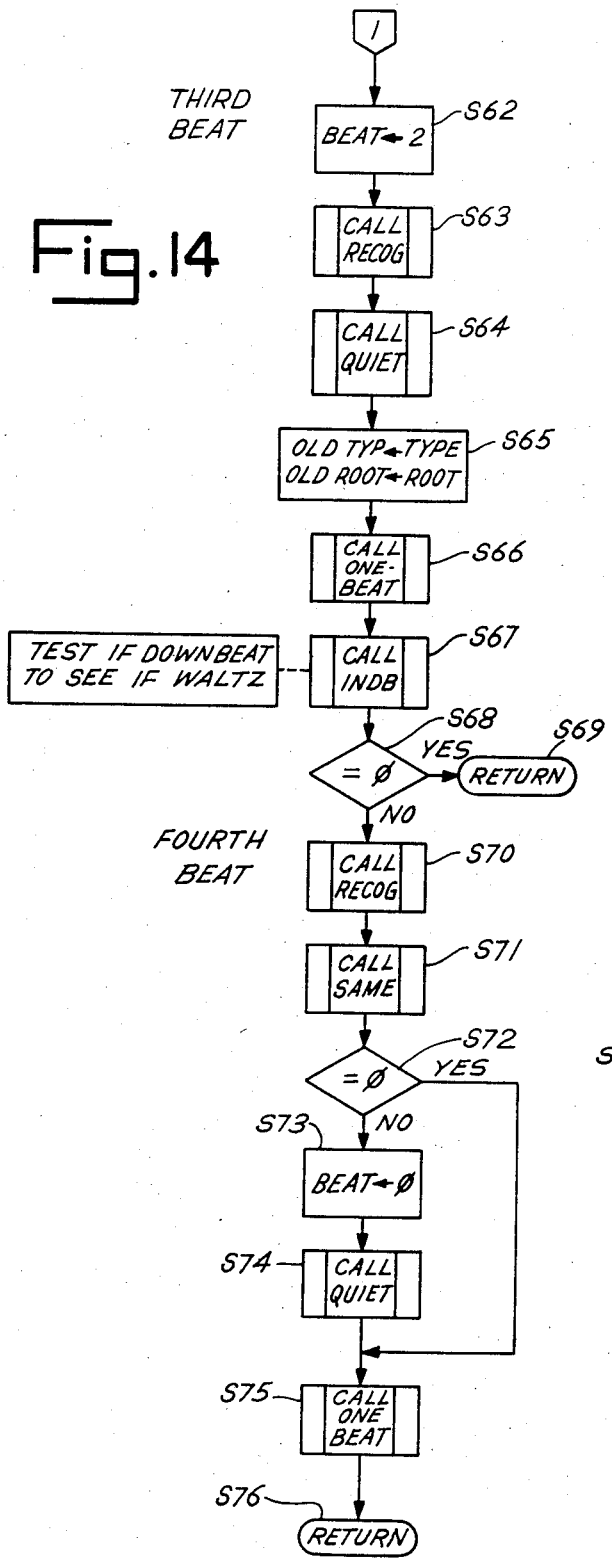
Fig. 14
Fig. 15
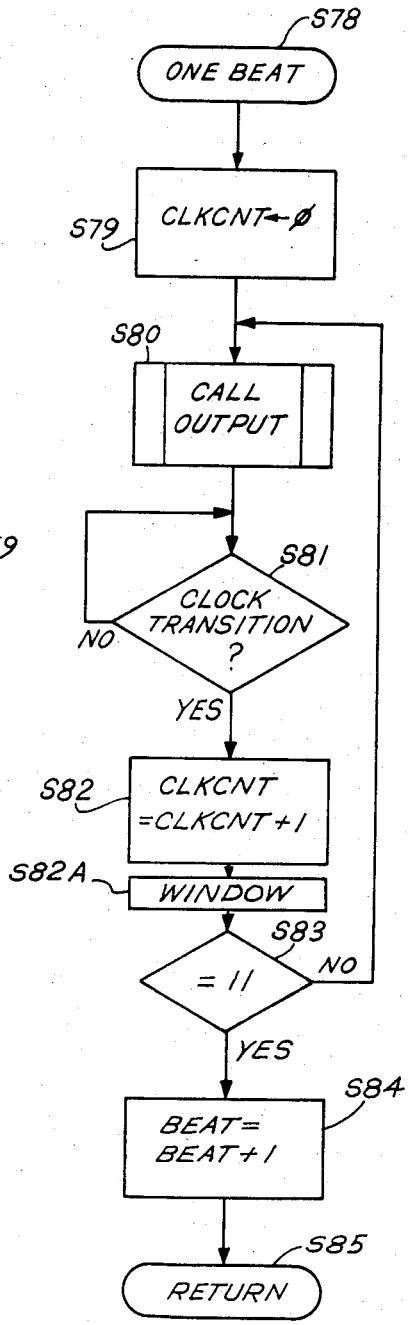

WINDOW
S120
IS CLKCNT ≤ 6
YES
NO
S121
CALL RECOG
CALL SAME
S122
DOES OLD TYPE=TYPE AND OLD ROOT=ROOT
S123
YES
NO
S124
IS BEAT=2 OR 4
NO
YES
BEAT = Ø
S125
CLKTEMP=CLKCNT
CLKCNT = Ø
OLD TYP = NEW TYPE
OLD ROOT = NEW ROOT
S126
CALL POOT
S127
DOES CLKCNT=CLKTEMP
S128
YES
NO
S129
CLKCNT = CLKCNT + 1

POOT

AUTOMATIC TEMPO SET

BACKGROUND OF THE INVENTION

This invention relates to the field of electronic musical instruments and, more particularly, to a method and apparatus for providing musical accompaniment at a plurality of different tempos and in different musical styles upon selection of one of the styles.

It has long been recognized in the musical performance industry that the proper selection of tempo can make or break a performance. It is therefore a major responsibility of a conductor or band leader to set the tempo for a performance. Proper tempo selection involves a great many considerations, such as, phrasing, orchestral treatment, rhythmic content and even the subjective intent of the composer. It is therefore often very difficult for an individual to select an appropriate tempo for a composition.

Electronic musical instruments have in the past incorporated tempo dependent features to promote ease of playing. Such features range from purely percussive accompaniment to full orchestral accompaniments. Regulation of the tempo at which an accompaniment is played has been achieved by generating a clock signal which is a multiple of the tempo beat rate. It has been the responsibility of the player to set the clock of the instrument so that the accompaniment is played at an appropriate rate. The rate may change significantly from one composition to another, for example, between a slow funeral dirge and a simple minuet. An instrument capable of performing a wide variety of music must therefore have a wide range of tempos available to choose from. The size of the range compounds the problem of tempo selection, making it difficult for performers with little experience or a poor sense of tempo to choose a musically correct tempo.

Attempts have been made to aid players of electronic musical instruments in the selection of an appropriate tempo. For example, the Kinsman organ, later manufactured by Seeburg, automatically adjusted the tempo to follow proportionally the rate at which the bass pedals were played. This allowed the player to dynamically alter the tempo of the accompaniment. It operated satisfactorily if the player had a good sense of tempo and played the bass pedals at a constant rate; however, it became unstable if the performer played either behind or ahead of the beat. If he played behind the beat, the tempo rate of the accompaniment would slow tremendously, causing the music to sound very badly.

Another prior accompaniment system altered the tempo clock rate when a style was changed in order to accommodate different sample rates of musical parameters within the system. Sample rates of 3 per beat were used for styles containing triplets and sample rates of 4 per beat were used for styles containing sixteenth notes. This meant that to play back accompaniments at the same beat rate, which was intended in the system, the clock rate was altered from three times the beat rate to four times the beat rate upon changing from a style containing triplets to one containing sixteenth notes. Any variation in playback rate was accomplished independently by the performer to accommodate the composition being played.

In addition, drum machines and music synthesizers have permitted musical compositions to be recorded by a player at different tempos and later sounded at those tempos in much the same manner as a tape recorder.

The rate of playback has been variable by the player and, in at least one case, the change from the tempo of the original recording has been automatically reset to zero upon selection of a different track or composition. Two machines of this type are a drum machine manufactured by Oberheim as Model DMX and a sequencer manufactured by Oberheim as Model DSX for use with a compatible synthesizer. However, these machines simply replay the sequence inputted by the performer and do not react dynamically to the playing of an instrument to choose a suitable accompaniment, in the manner of many musical instruments having automatic accompaniment features. They are purely passive in this regard.

Therefore, it is desirable in many applications to provide a simple and effective system for assisting the performer of an electronic musical instrument in choosing an appropriate tempo.

SUMMARY OF THE INVENTION

The present invention comprises a method and apparatus for providing musical accompaniment in different musical styles to the playing of an instrument, upon selection of one of the styles. The method comprises the steps of providing, in response to a selected musical style, a tempo rate characteristic of the style; providing an accompaniment in dynamic response to playing of the instrument; and sounding the accompaniment at said tempo rate. In a preferred embodiment, the tempo rate is provided by generating a timing signal of preselected frequency in response to the selected musical style, and the accompaniment comprises a plurality of musical notes sounded in response to the timing signal. In a further embodiment, the method includes establishing a range of permissible deviation from the frequency of the timing signal in response to the selected style, and enabling the performer to alter the frequency of the timing signal within the range. The method may then include the step of resetting the deviation to zero in response to a change in the selected style, such that the accompaniment is sounded at a second tempo rate characteristic of the newly selected style unless a deviation is subsequently entered by the performer. The second tempo rate may be either the same as the original tempo rate or different from it, depending upon the characteristics of the two styles. The frequency of the timing signal is a preselected multiple of the characteristic tempo rate for the selected musical style, and is preferably a ratio evenly factorable by three and four, such as twelve.

One of the most significant factors in selecting an appropriate tempo is the style or type of music to be performed. In the context of the present invention, this factor is determined when the performer selects one of the "styles" of accompaniment offered by the instrument. The other factors influencing tempo selection are largely determined at the same time because each accompaniment is a short musical composition, prewritten and prearranged to implement the respective style. It is therefore possible to define a preferred tempo, and a corresponding range of permissible deviation in tempo, for each of the selectable styles of accompaniment.

The present invention includes a simple and automatic system for providing a tempo appropriate to the selected musical style. Any deviation from the preferred tempo is limited to deviation within a narrowly defined range of acceptable tempos for the style. A performer of limited skill therefore automatically obtains the optimum tempo for a particular style automatically upon selection of the style, and cannot vary the tempo beyond the acceptable range. Even when the preferred tempo is less than perfect, it is far better than one chosen by an inexperienced musician without the benefit of the present system. In any event, the performer can "fine tune" the tempo rate, if desired, by varying it within the range of deviation.

The system of the present invention also allows a performer to change styles rapidly, without stopping to adjust the tempo. A new preferred tempo is automatically provided when the style is changed. This feature works to the benefit of experienced musicians, as well as less experienced ones.

The deviation in tempo rate made by the performer is a "true deviation", in that it applies only to the style selected at the time it is made and is not carried over by the system when the style is changed. Thus, a performer playing in the bossa nova style can dial in a deviation for that style without affecting the tempo obtained when he later changes to a jazz guitar style. The deviation is reset to zero each time the style is changed.

Alternatively, the system of the present invention can be made to provide a range of permissible tempo rates for each musical style, without selecting a preferred rate within the range. The performer is unencumbered in his choice of tempo within the range, but cannot vary the tempo beyond the range.

DESCRIPTION OF THE DRAWINGS

These and other features of the present invention appear for purposes of illustration, but not of limitation, in connection with the accompanying drawings, wherein like numbers refer to like elements throughout, and wherein:

FIG. 11–19 are flow charts illustrating certain aspects of the overall operation of the preferred embodiment;

DESCRIPTION OF THE PREFERRED EMBODIMENT

Figure 1:
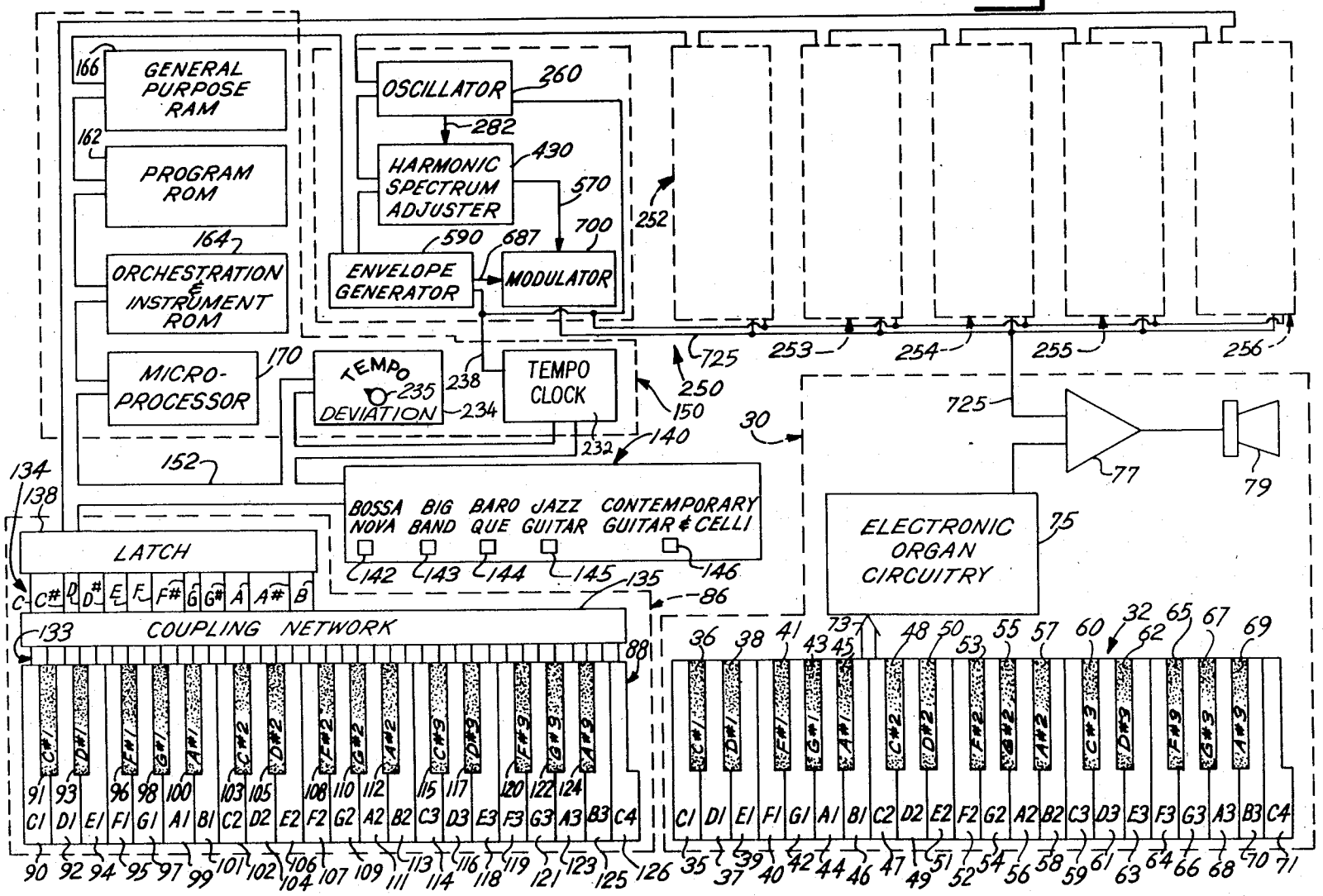
FIG. 1 is a logical block diagram of a preferred form of musical instrument made in accordance with the present invention.

The present invention is an improvement on an electronic musical instrument described in U.S. Pat. No. 4,433,601 entitled "Orchestral Accompaniment Techniques", issued Feb. 28, 1984 to R.J. Hall, G.R. Hall and J.C. Cookerly, and in U.S. Pat. No. 4,311,077 entitled "Electronic Musical Instrument Chord Correction Techniques", issued Jan. 19, 1982 to the same inventors. The teachings of the foregoing application and patent are hereby incorporated by reference.

1. General Capabilities

The electronic musical instrument of the foregoing application and patent is capable of providing a full orchestral accompaniment to a melody played in any one of the 12 possible harmonic keys. The accompaniment is dynamically controlled by the left hand of a performer who is playing the melody with his right hand on a melody keyboard. The accompaniment is sounded by the instrument in any one of a variety of different musical "styles", such as bossa nova, big band, baroque, jazz guitar, or contemporary guitar and celli. The musical style desired by the performer is selected by a switch located on the instrument console.

For purposes of the present invention, the word "style" designates any of a wide variety of musical treatments for which prewritten and prearranged accompaniment segments are provided by the musical instrument. Each style is characterized by specific rhythmic patterns, harmonic patterns, melodic patterns, orchestral content and musical phrasing. In addition to the "styles" listed above and shown in the preferred embodiment, the instrument can be expanded to incorporate, without limitation, the styles of tango, fox trot, swing, samba, mambo, cha-cha, rhumba, ballad, country western, march, march polka, fifties ballad, slow dance, classical guitar, disco, funk and bugaloo.

An important aspect of the present invention is the fact that the instrument automatically selects a preferred tempo rate, and a range of permissible deviation from that rate, in response to the selected musical style. The accompaniment is sounded by the instrument at the preferred rate, with the performer able to adjust the rate only within the permissible range. The tempo provided by the instrument is therefore always appropriate for the selected musical style, regardless of the skill of the performer.

The instrument automatically and dynamically relates the accompaniment to the harmony selected by the left hand of the performer on a harmony keyboard. Thus, the accompaniment is sounded both in the style and harmony selected by the performer as most appropriate for the melody he is playing.

The instrument normally generates a segment of orchestrated accompaniment music which is repeated after every two musical bars. That is, a normal segment of accompaniment music consists of two musical measures or bars, and each bar contains four musical beats.

A waltz segment consists of two bars, and each bar contains three beats.

The instrument analyzes the manipulation of the harmony keyboard in order to ascertain the accompaniment harmony desired by the performer. In particular, the instrument identifies a specified chord type and root note. The chord types recognized by the instrument are major, minor, diminished, augmented and seventh, and the root note can be any of the twelve notes of the musical chromatic scale.

In order to add variety to the musical accompaniment segments, the twelve possible roots are divided into four groups as follows:

| Group Number | Root Note |
|---|---|
| 0 | C, C#, E |
| 1 | D#, F#, and D |
| 2 | F, G#, and A |
| 3 | G, A#, and B |

(Throughout this specification, a musical sharp is indicated by the symbol #).

As described in detail in connection with FIGS. 15–18, the segment of accompaniment music produced by the instrument tends to change dynamically each time the performer plays a new chord type or a chord in a new root group. In this context, the term "dynamic" describes the real time response of the instrument to the harmony selected as it is played. Since there are five possible chord types and four possible root groups, twenty different and unique musical segments can be produced for each musical style. In other words, for any given style of music, there are twenty different music segments arranged to express the style.

II. Description of Harmony Selection, Style Selection, Processing And Tempo Apparatus Referring to FIG. 1, a preferred form of electronic musical instrument having the foregoing capabilities basically comprises a melody system 30, a harmony selection system 86, a musical style selector 140, a processing system 150 and an output system 250. As shown in FIG. 1, melody system 30 includes a conventional melody keyboard 32 which comprises playing keys 35–71. Each of the keys represents at least one note which is pitched in at least one octave. Keyboard 32 is connected through a cable 73 to conventional electronic organ circuitry 75. The circuitry produces audio tone signals based on the melody keys depressed by the performer in a well-known manner. The tone signals are transmitted through an output amplifier 77 to a conventional loudspeaker transducer 79 which converts the signals to sound.

Harmony selection system 86 comprises a harmony keyboard 88, including playing keys 90–126. The keys operate switch contacts 133 which correspond to switches 23 described in U.S. Pat. No. 3,745,225 (Hall–July 10, 1973, hereafter the "3,745,225 Patent"). The switch contacts are connected to output conductors 134 (corresponding to conductors 24 of the 3,745,225 Patent) by a coupling network 135 of the type described in that patent. Conductors 134 are connected to a conventional 12 bit latch 138 which can be addressed and read by processing system 150.

Each of the keys of keyboard 88 represents at least one note pitched in at least one octave. One such note and octave is printed on the keys in FIG. 1. For example, key 90 is used to produce at least a C note pitched in octave 1, and key 106 is used to produce at least an E note pitched in octave 2. As explained in the 3,745,225 Patent, coupling network 135 is arranged so that the playing of any key on keyboard 88 which corresponds to a C note results in a logical one signal on the C conductor of group 134, irrespective of the octave in which the C note is pitched. For example, the C conductor in group 134 will be raised to a logical one state if any or all of keys 90, 102, 114 or 126 are depressed by a performer. As a result, the input to latch 138 represents each of the notes produced by a performer's manipulation of keyboard 88, but does not indicate in which octave any of the notes are pitched.

Musical style selector 140 comprises switches 142–146 by which a performer can select several musical styles. In response to the depression of one of switches 142–146, an eight bit word corresponding to the desired style is stored in a conventional eight bit register contained within selector 140. The word is read by processing system 150 and is used in a manner described later. Of course, the instrument could be expanded to include other musical styles, depending on the size of the processing system desired. Those skilled in the art readily will be able to expand the scope of the instrument to include other musical styles based on the present teaching.

Figure 2:
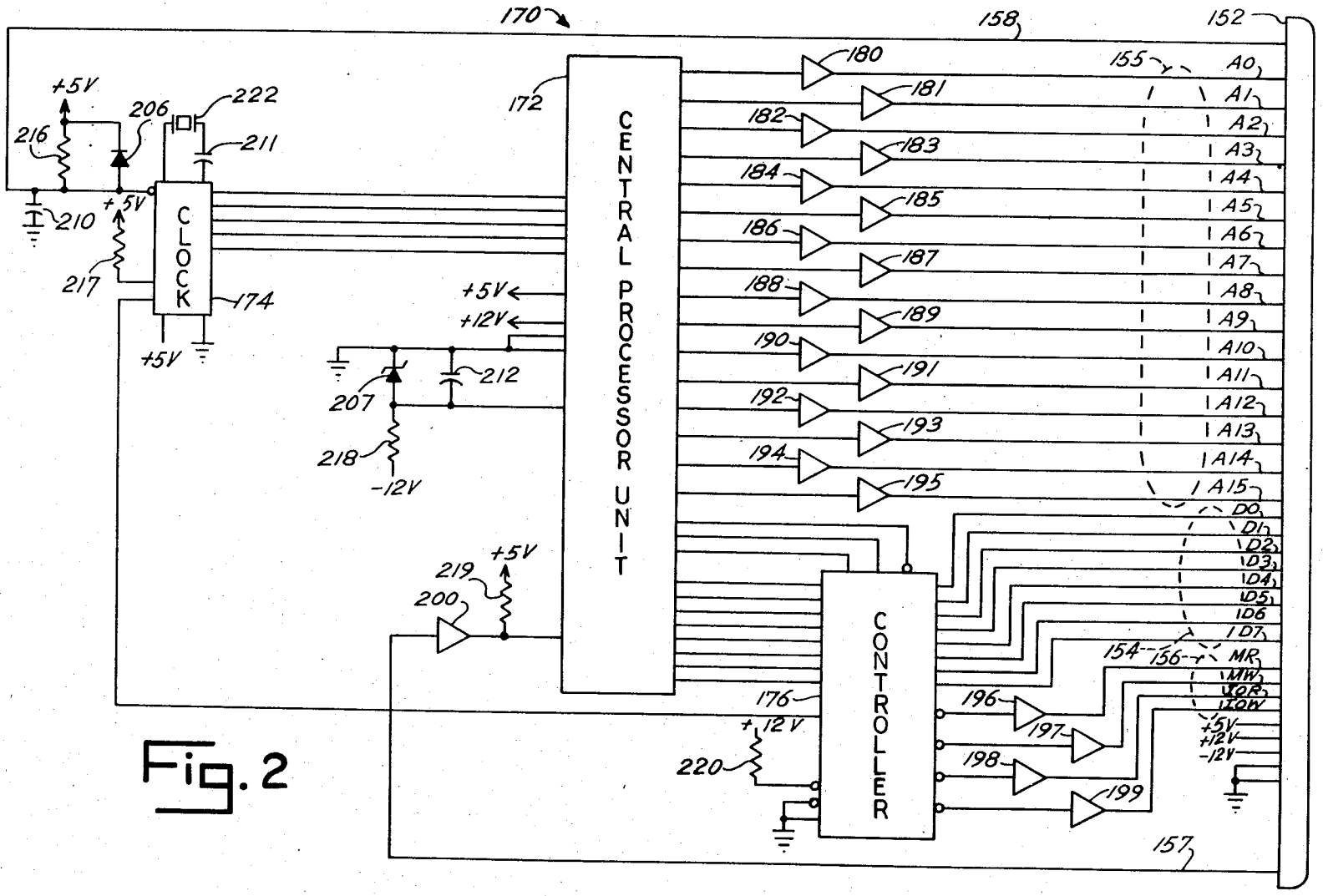
FIG. 2 is an electrical schematic diagram of a preferred form of microprocessor made in accordance with the present invention.

Referring to FIGS. 1 and 2, processing system 150 comprises a communication bus 152 that is subdivided into an eight bit data bus 154, a sixteen bit address bus 155, a four bit read-write bus 156, an interrupt line 157 and a clock line 158.

The processing system also includes a program read only memory (ROM) 162 which stores instructions for the overall system. An orchestration and instrument ROM 164 stores digital information necessary for the production of the musical segments. A general purpose random access memory (RAM) 166 is used to hold intermediate variables and working data pointers used by a microprocessor 170 which performs sequential programmed logic functions in order to operate the system.

Referring to FIG. 2, microprocessor 170 comprises a central processor unit 172 which may be a general purpose microcomputer, such as model 8080 manufactured by Intel Corporation. The microprocessor also includes a processor clock 174 which may be a model 8224 manufactured by Intel Corporation, and a system controller 176 which may be a model 8228 manufactured by Intel Corporation. The microprocessor also includes amplifiers 180–200, diodes 206–207, capacitors 210–212, resistors 216–220, and a crystal 222, all connected as shown.

Figure 3:
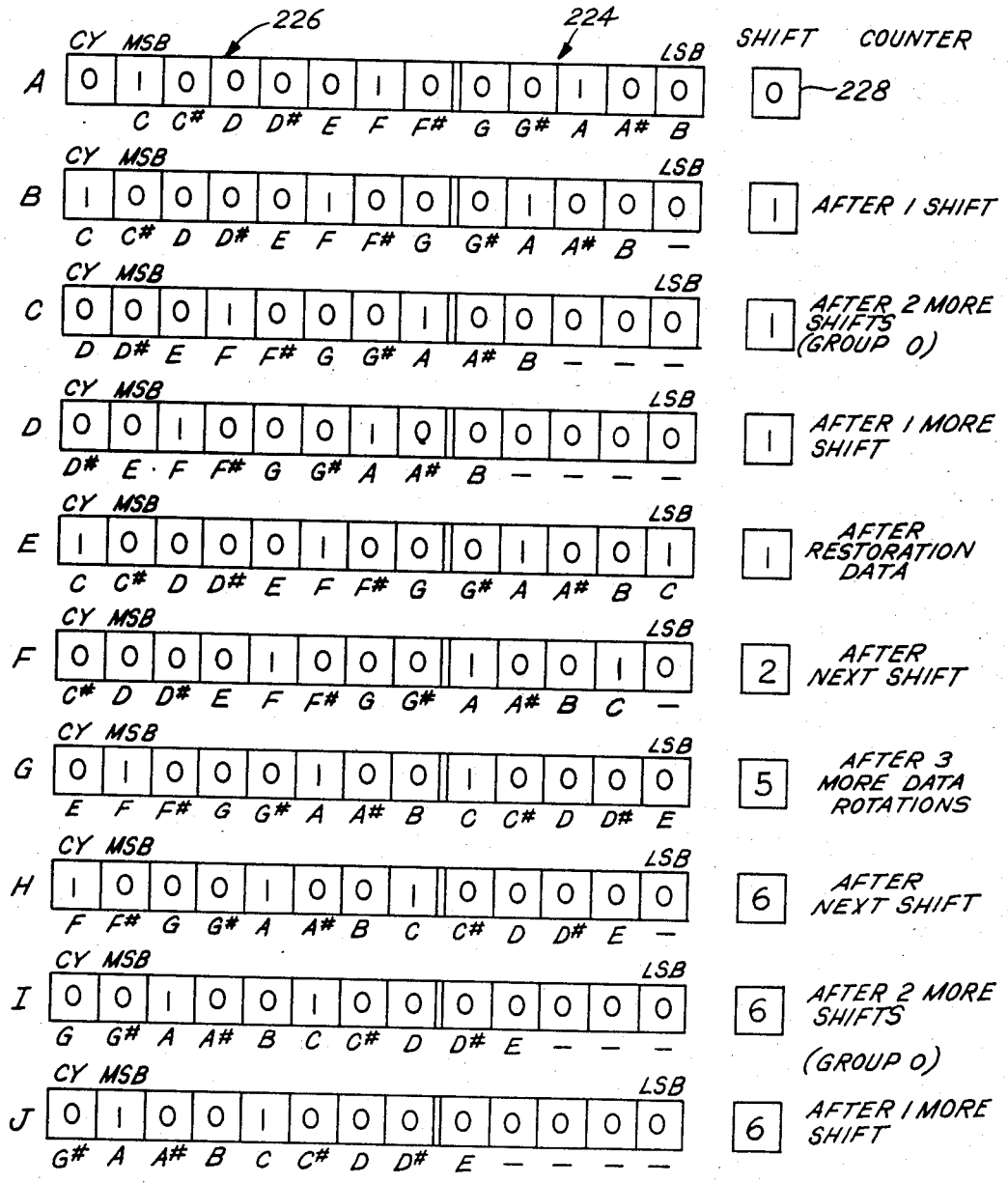
FIG. 3 is a block diagram illustrating the operation of certain registers in the microprocessor.

Referring to FIG. 3, microprocessor 170 also includes a four bit register 224 and an eight bit register 226 that comprises a carry bit CY, a most significant bit MSB and a least signficant bit LSB. The purpose of a shift counter bit 228 is described later.

Referring now to FIG. 1, with specific reference to the improvement of the present invention, a tempo clock 232 and a tempo deviation unit 234 are provided to synchronize the system with the performer and to maintain the tempo of the accompaniment within a preselected range suitable for the selected musical style. A preferred tempo rate is automatically provided in response to selection of one of the musical styles 142 through 146, and the tempo can be adjusted within a preselected acceptable range by rotating a knob of a tempo deviation input device 235. The tempo deviation knob is mounted on a continuously rotatable shaft which is position encoded in such a manner that the "home" position may be reset by the microprocessor. There are preferably no markings to imply that any specific point should be the home or "reset" position. The tempo deviation input device can be read by the processor 170 to indicate the present condition of rotation of the knob. Devices of this type are commercially available in a number of forms, such as that used in Oberheim Synthesizer Model No. OBX, and similar instruments. In the context of the present invention, tempo rate can be increased or decreased within the acceptable range to suit the performer. However, the rate cannot be varied beyond the preselected range because the resulting tempo would be unsuitable for the selected musical style.

The tempo clock 232 issues a tempo signal made up of 12 clock pulses per musical beat so that it can resolve a quarter note beat into eighth notes, sixteenth notes or triplets. A normal musical bar consists of four beats; each bar is broken into two parts, each of which has two beats. A waltz-type bar consists of three beats; each bar is broken into two parts, the first part being two beats and the second part being one beat.

The tempo clock is used by the system to establish a pattern for repetition of the two bar musical segments. A segment is repeated after every two bars. That is, a normal segment consists of two bars, each made up of four beats so that an eight beat pattern results. A waltz segment consists of two waltz bars having three beats per bar, so that a six beat pattern results. The output of the tempo clock 232 is automatically adjusted to the appropriate time pattern, i.e., 4/4 time or 3/4 time, in response to selection of the musical style. The tempo clock generates a downbeat pulse at the beginning of each musical bar to synchronize the system in a manner described below. The downbeat pulse and tempo clock pulses are transmitted to other parts of the system over data bus 154 and conductor 157.

Figure 22:
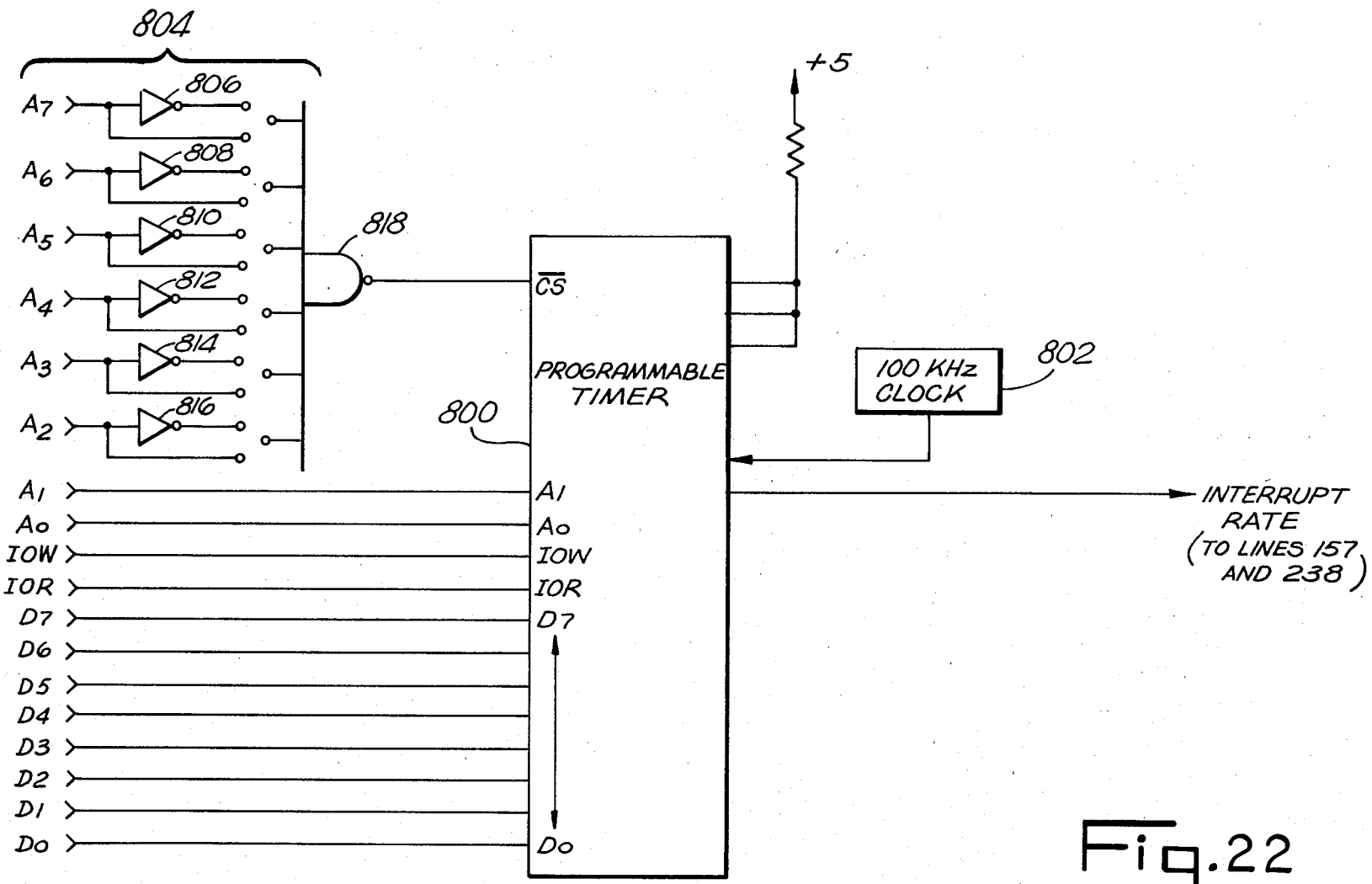
FIG. 22 is an electrical schematic diagram of a preferred form of tempo clock circuit made in accordance with the present invention.

The tempo clock 232, shown in more detail in FIG. 22, comprises a programmable timer 800 which receives 100 kilohertz clock pulses from a clock 802 and issues an output tempo signal. The output signal is transmitted to the microprocessor 170 along the interrupt line 157 of the communication bus 152, and to the envelope generator 590 along the line 238. The timer 800 can be implemented by Intel Model No. 8253, which is operated in mode 3, the square wave generator mode, and is described in the Intel data catalog for 1977 at page 10-159.

The timer 800 is selected for reception of data over the data bus 154 by an appropriate address applied to the lines $A_2$ through $A_7$ of the address bus 155. Assuming the timer has been initialized at power up, the address acts through a selection circuit 804 to take a "chip select" ($\overline{CS}$) input of the timer to a low level. The selection circuit comprises a series of inverters 806 through 816, which can be connected selectively to a NAND gate 818. A two bit input is simultaneously applied to the lines $A_0$ and $A_1$ to address the appropriate internal register of the timer 800. A low signal is then asserted on the "write" line IOW, causing the information on the data lines $D_0$ through $D_7$ to be transferred to the appropriate internal register of the timer.

The information on lines $D_0$ through $D_7$ is an 8-bit segment of a 16-bit number transferred in two steps from the microprocessor 170. The signal of the clock 802 is divided by this number to obtain the desired tempo clock signal. Thus, the divisor received from the data lines determines the repetition rate of square wave pulses outputted by the timer, controlling the rate at which the musical accompaniment is played. When the accompaniment style is changed, or the performer deviates from the preferred tempo rate by turning the knob 235, a low logical signal is applied through the selection circuit 804 to the $\overline{CS}$ input of the timer 800 to initiate a change in tempo. This is followed by a low signal on the line IOW, whereupon the divisor for the new tempo is entered from the data lines $D_0$ through $D_7$.

III. Harmony Recognition

Harmony selection system 86 cooperates with processing system 150 in order to recognize the harmony indicated by the depression of one or more keys of keyboard 88 by the performer. Of course, the preferred embodiment could be implemented with a chord organ-type pushbutton system in which a separte button is provided for each chord type and root note desired by the performer. However, such a pushbutton system is not satisfying to the more advanced musician who is used to playing on a keyboard in order to establish the harmony of his musical performance.

By using the following technique, the harmony desired by the performer can be recognized solely from his manipulation of keyboard 88. In order to recognize any chord type, the microprocessor attempts to match a representation of a playing key pattern with a corresponding chord type and root. In order to achieve this result, signal-responsive representations of various playing key patterns are stored in memory. A performer may express a desire for a particular chord type based on a particular root by depressing the playing keys according to a number of different patterns. For example, the performer may express a desire for C minor harmony (i.e, chord type minor, root C) by actuating any one of the following key patterns:

1. C, D#
2. C, D#, G
3. C, D#, G, B
4. C, D#, B
5. D#, F, A#
6. C, D#, F, A#

These key patterns can be used by the processor in order to derive a chord type signal indicating the chord type desired by the performer and a root signal indicating the root note of the harmony desired by the performer.

More specifically, for each chord type desired to be recognized, a plurality of chord pattern signals representing corresponding key patterns are stored in memory locations having addresses related to that chord type. After the chord pattern signals have been stored, harmony selection system 86 generates a playing key pattern signal identifying the pattern of the playing keys actuated by the performer and also identifying at least one note represented by at least one of the actuated playing keys. The playing key pattern signal then is used in an attempt to locate a corresponding stored chord pattern signal. The chord type signal and root signal are derived from the corresponding chord pattern signal.

As previously explained, harmony selection system 86 produces on conductors 134, a multi-bit representation of the keys of keyboard 88 acuated by a performer. The note represented by an actuated key is represented on one of conductors 134 irrespective of the octave in which it occurs. For example, the C conductor of bus 134 is raised to a logical one state if any one of keys 90, 102, 114 or 126 representing C notes sounded in octaves 1, 2, 3 or 4 respectively, are actuated. Referring to FIG. 1 and 3, the twelve bit representation of the playing key pattern is stored in latch 138 and is transferred by processor 170 into four bit register 224 and eight bit register 226 over bus 152.

Figure 5:
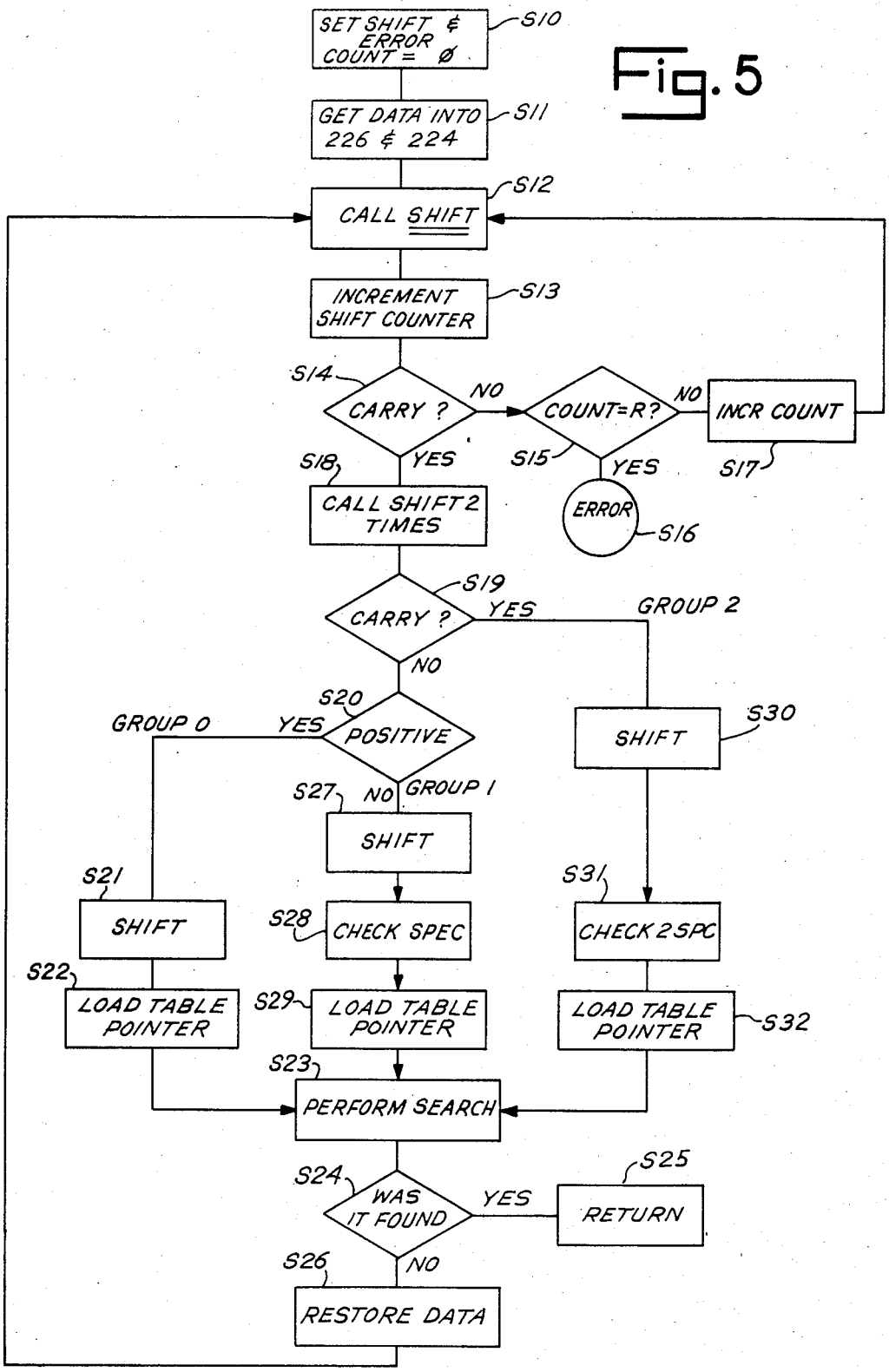
FIG. 5 is a flow chart illustrating the manner in which the processor determines the harmony desired by a performer.

FIG. 5 describes the harmony recognition routine of the program instructions stored in ROM 162. Briefly, the twelve bit playing key pattern signal stored in registers 224,226 can be reduced to an eight bit representation by judiciously testing certain bits and properly grouping others. Details of the harmony recognition routine are given in the above-identified application Ser. No. 307,161 which is incorporated by reference.

Figure 4:
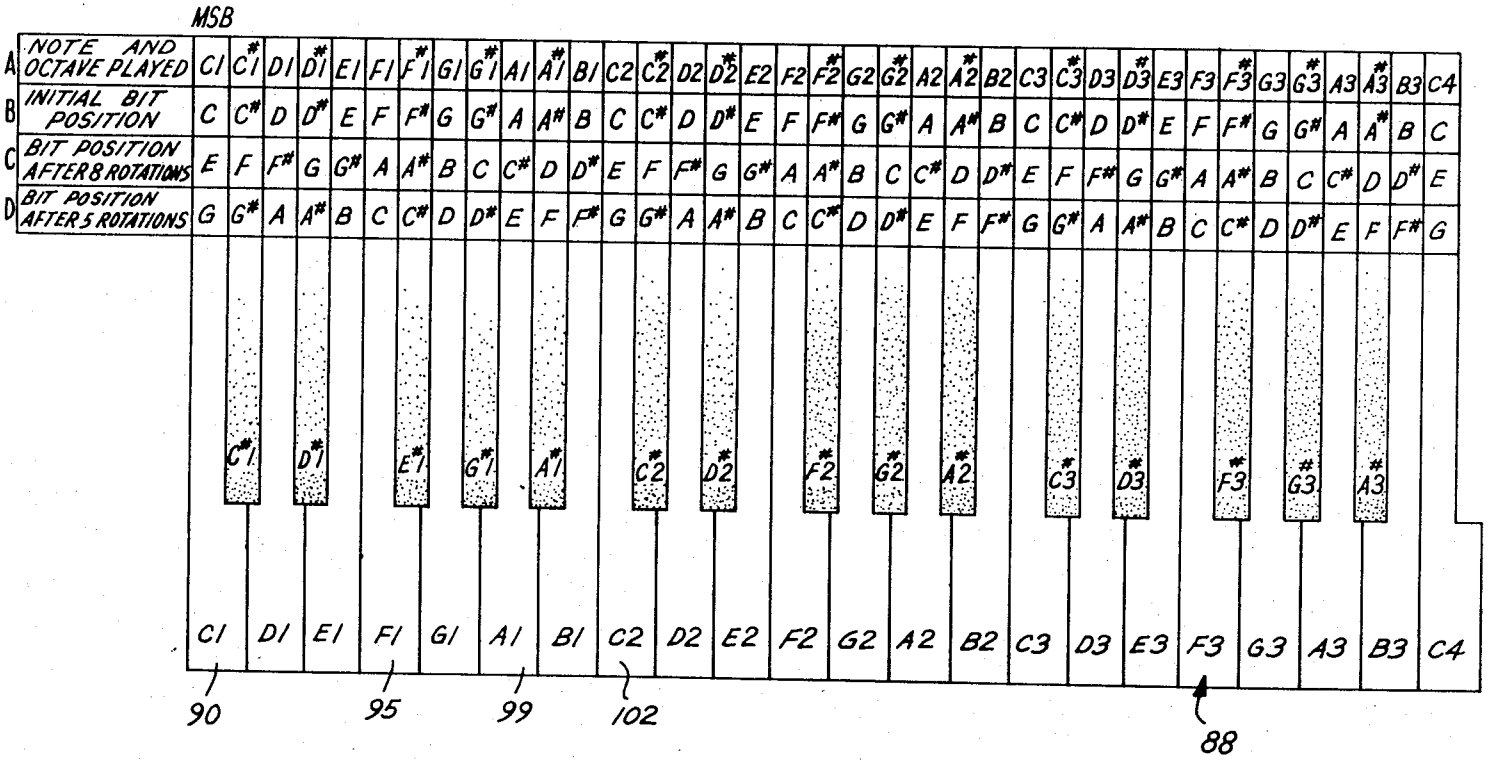
FIG. 4 is a chart illustrating the general operation of the registers shown in FIG. 17.

FIG. 4 illustrates how the data representing any combination of played keys is shifted through registers 224,226. Line A represents the notes and octaves resulting from the playing of the keys aligned with the entries in line A. Line B illustrates the notes initially represented by the bit positions in registers 224,226. Lines C and D illustrate the notes represented by the bit positions of registers 224,226 after 8 and 5 data rotations, respectively. With the aid of FIG. 4, those skilled in the art can readily trace the rotation of data representing any combination of played keys.

IV. Output Hardware

Referring to FIG. 1. output system 250 comprises identical voice systems 251–256. Each of the voice systems is capable of simulating a separate instrument or voice by which segments of musical accompaniment can be expressed. At any one time, any voice system can sound like any instrument the system is capable of simulating. In other words, the individual voice systems are not confined to a single voice or instrument simulation.

Each of the voice systems can be understood from the following description of system 251. System 251 basically comprises an oscillator circuit 260, a harmonic spectrum adjuster 430, an envelope generator 590 and a modulator 700.

Figure 6:
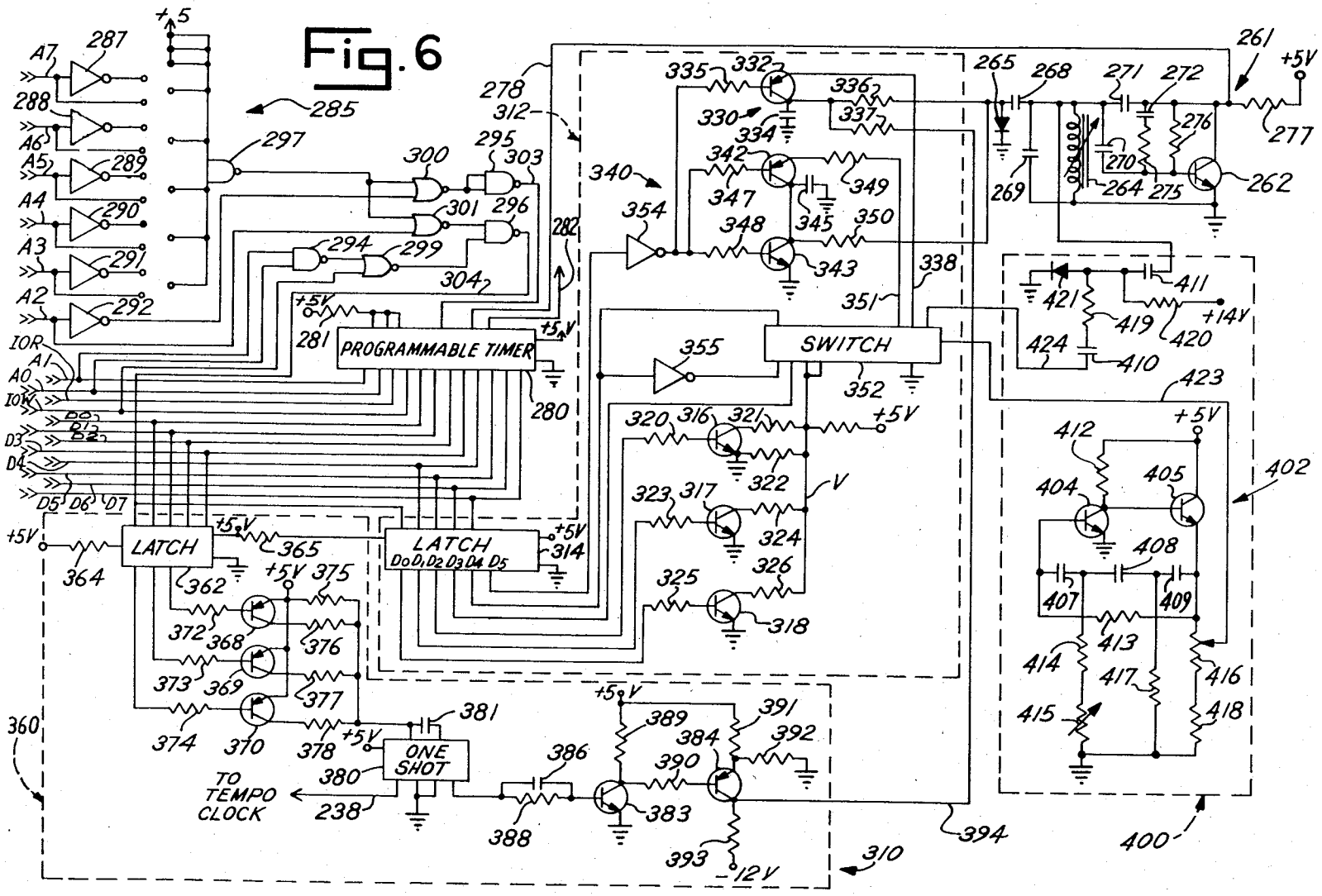
FIG. 6 is an electrical schematic diagram of a preferred form of oscillator used in connection with the present invention.

Referring to FIG. 6, oscillator 260 basically comprises an oscillator circuit 261, a selection circuit 285, a portamento module 310, and a vibrato module 400. Oscillator 261 includes a transistor 262, an inductor 264, a diode 265, capacitors 268–272 and resistors 275–277, connected as shown. The signals generated by the oscillator are transmitted to an input of a programmable timer 280 over a conductor 278. The timer can be implemented by Intel Model No. 8253 which is operated in mode 3, the square wave generator mode, and is described in the Intel data catalogue for 1977 at page 10-159. The timer is biased by a resistor 281 and generates square wave pulses on a conductor 282 at a repetition rate determined by the frequency of the oscillator and the interaction between the oscillator and the other modules shown in FIG. 6.

The operation of oscillator circuit 260 is controlled by the data processor over bus 152 under the supervision of selection circuit 285. Selection circuit 285 includes inverters 287–292, NAND gates 294–297, and NOR gates 299–301. Appropriate inverters are connected to gate 297 depending on the precise addressing code used on conductors A2–A7. By transmitting the proper bit pattern over the address bus, either a pitch select line 303 or a portamento select line 304 is raised to a logical one state. In the event the pitch line is selected, timer 280 is enabled to receive information over data bus $D_0$–$D_7$ which determines the repetition rate of the square wave pulses produced on output conductor 282. In the event the portamento line is selected, the portamento module is enabled to receive information over the data bus which controls the pitch and rate of the portamento feature.

Portamento module 310 includes a portamento pitch control circuit 312 comprising an addressable latch 314 which receives information from the data bus. The latch, in turn, controls transistors 316–318 and associated resistors 320–326 which generate a voltage V that determines the upper and lower portamento pitches.

Module 310 also includes a portamento slide up circuit 330 comprising a transistor 332, a capacitor 334 and resistors 335–337 connected as shown. A portamento slide down circuit 340 is also provided by connecting transistors 342,343, a capacitor 345 and resistors 347–350 as shown. The portamento slide up and slide down circuits are controlled by a quad bilateral switch 352 and by inverters 354, 355.

Module 310 also includes a portamento rate control circuit 360 comprising an addressable latch 362, resistors 364–365, switching transistors 368–370, resistors 372–378, a one shot multi-vibrator 380 controlled by a timing capacitor 381, and an amplifier circuit comprising transistors 383,384, a capacitor 386, and resistors 388–393. The output of the amplifier circuit is transmitted over a control line 394 to portamento slide up circuit 330.

Vibrato module 400 includes an oscillator 402 containing transistors 404,405, capacitors 407–411, resistors 412–420 and a diode 421, all connected as shown.

Assuming neither the portamento nor vibrato features are used, oscillator 261 generates a signal which is a multiple of the frequency desired for voice system 251. If a lower frequency is desired, a divisor number equal to the divisor required to achieve that lower frequency is transmitted to timer 280 over the data bus. The timer divides the frequency of the input from oscillator 261 by said divisor number in order to produce pulses on conductor 282 having a repetition rate corresponding to the desired frequency or pitch of the note produced by system 251.

Voice system 251 can be instantaneously quieted or silenced by entering the proper data in timer 280 from data bus 154. The timer then enters a non-counting mode which prevents output pulses on conductor 282. This mode of operation is controlled by a QUIET software routine.

The operation of the voice system 251 during vibrato and portamento modes of operation is described in the above-identified application Ser. No. 307,161.

Figure 7:
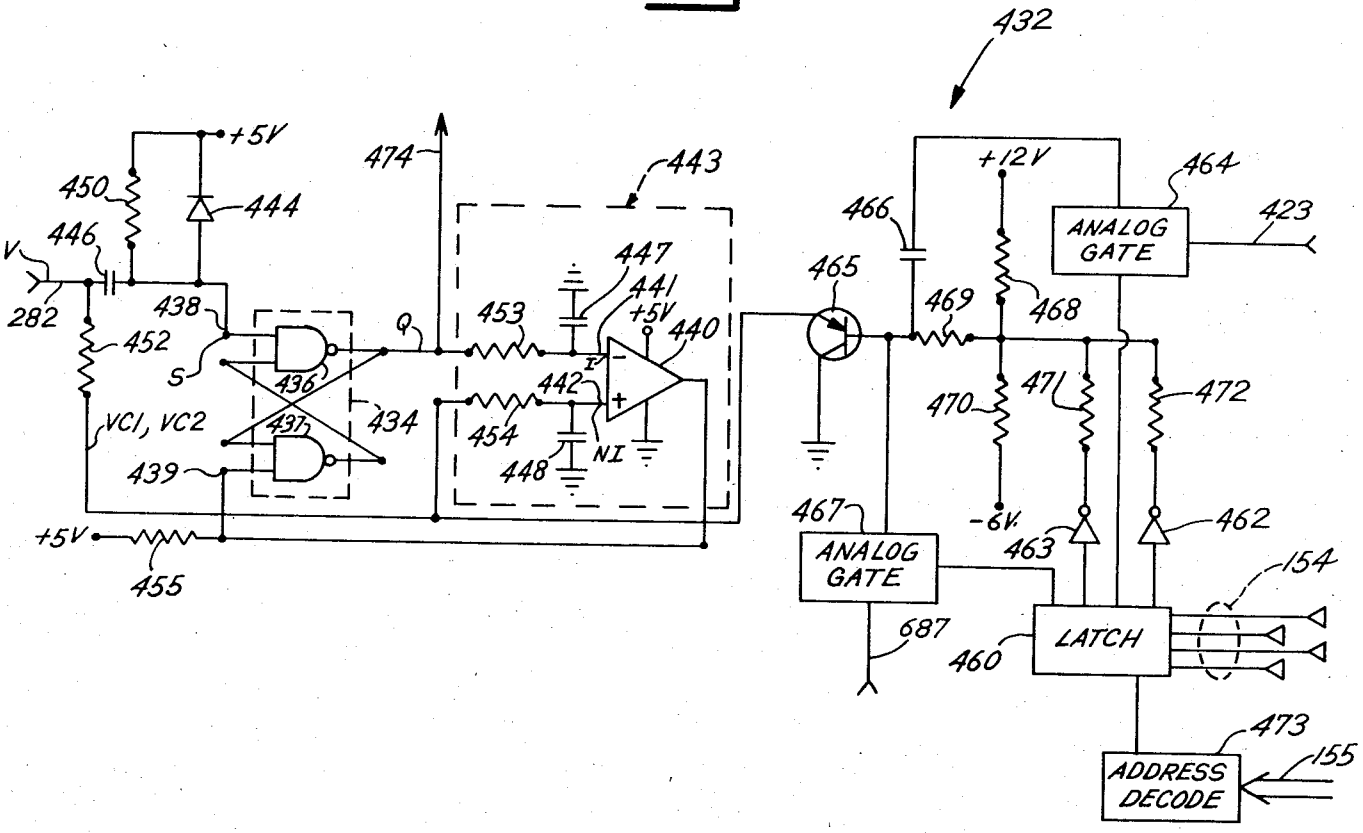
FIG. 7 is an electrical schematic diagram of a preferred form of duty cycle adjustment circuit used in connection with the present invention.

Referring to FIG. 7, harmonic spectrum adjuster 430 comprises a duty cycle adjusting circuit 432 that includes a flipflop 434 consisting of NAND gates 436,437, a set input 438 and a reset input 439. An operational amplifier 440 having an inverting input 441 and a noninverting input 442 is configured as a balanced comparator 443. The input signal from conductor 282 is differentiated by a capacitor 446 and a resistor 450, and the positive pulse resulting from the differentiation is removed by a diode 444. Additional capacitors 447,448 and resistors 451–455 are connected as shown. Resistors 453, 454 have the same value and capacitors 447, 448 have the same value in order to provide a balanced comparison by amplifier 440.

The overall operation of the circuit is described in detail in the above-identified application Ser. No. 307,161.

Figure 8:
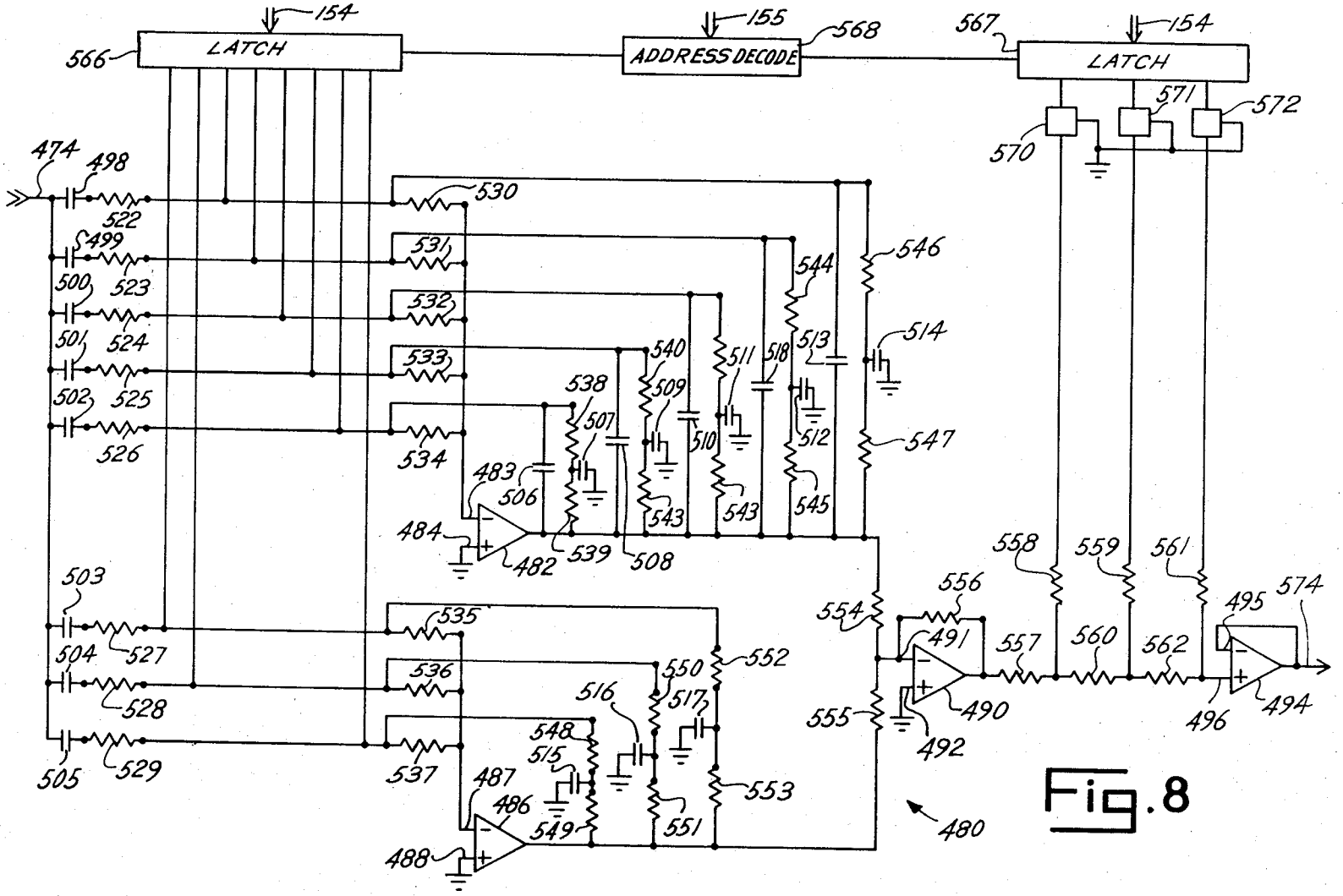
FIG. 8 is an electrical schematic diagram of a preferred form of programmable filter used in connection with the present invention.

Referring to FIG. 8, harmonic spectrum adjuster 430 also comprises a programmable filter 480. The filter includes operational amplifiers 482, 486, 490 and 494 having inverting inputs 483, 487, 491 and 495, respectively, and noninverting inputs 484, 488, 492 and 496, respectively. The filter also includes capacitors 498–518, resistors 522–562, latches 566,567, and address decoder 568, open collector gates 570–572 and an output conductor 574, all connected as shown. When enabled by address decoder 568, latch 566 enables one or more of the resistor-capacitor pairs to be connected into the feedback loops of operational amplifiers 482 or 486 in order to provide adjustable filtering of the pulses received on input conductor 474. When enabled by address decoder 568, latch 567 enables one or more of resistors 558–561 to be connected into the output of operational amplifier 490 through gates 570–572 in order to provide variable attenuation of the filtered signals.

Figure 9:
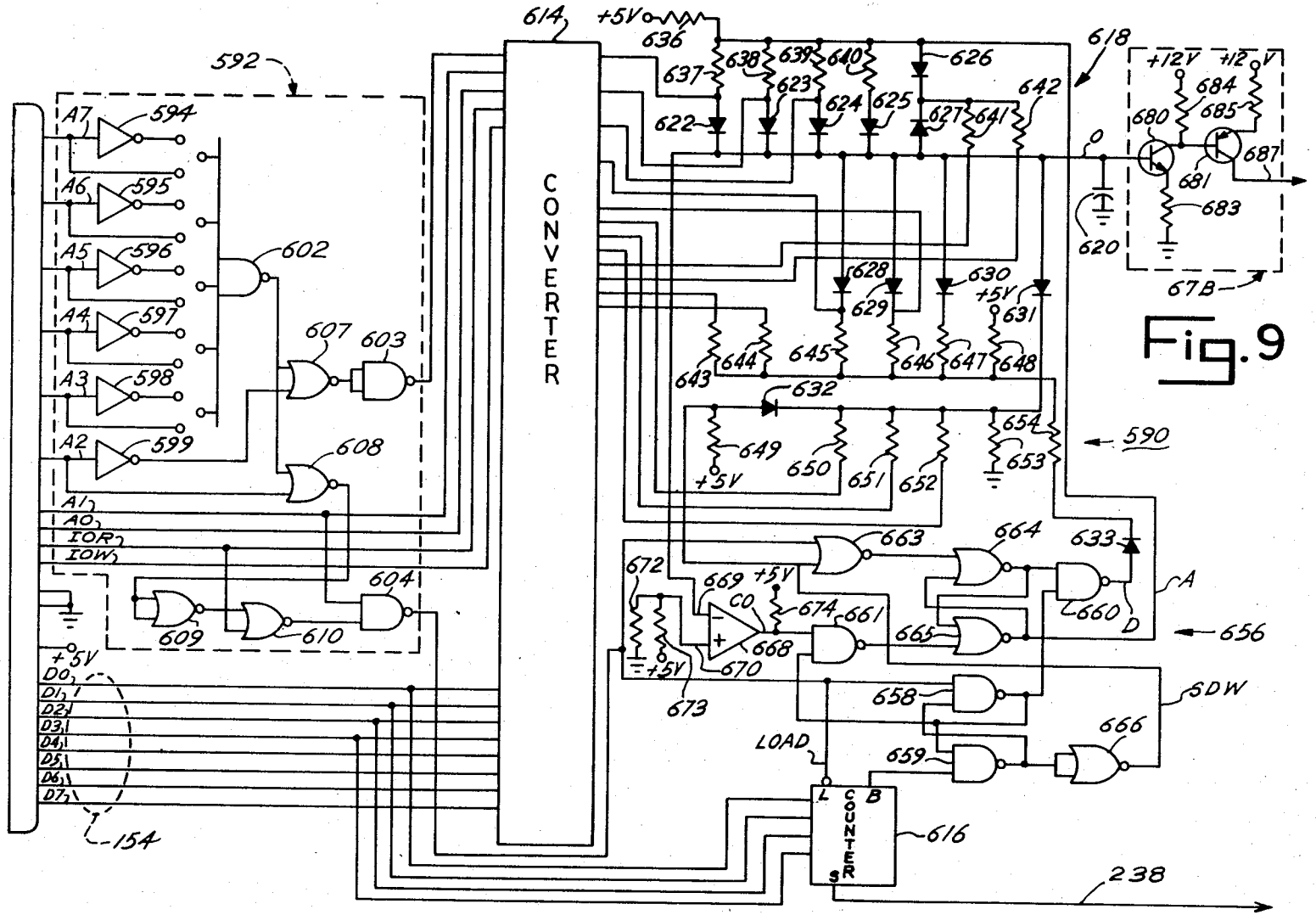
FIG. 9 is an electrical schematic diagram of a preferred form of envelope generator used in connection with the present invention.

Referring to FIG. 9, envelope generator 590 basically comprises an address decoding circuit 592, a parallel-to-parallel converter 614, a counter 616, a time constant circuit 618, a control logic circuit 656 and an output amplifier 678.

The address decoding circuit includes inverters 594–599, NAND gates 602–604 and NOR gates 607–610. The decoding circuit is responsive to signals on the address bus to enable converter 614 or counter 616 to receive information from data bus 154. Converter 614 is a 12-bit wide, open collector latch in which the outputs are grounded or allowed to float under programmed control.

Time constant circuit 618 comprises a timing capacitor 620, diodes 622–633 and resistors 636–654, all connected as shown.

Control logic circuit 656 includes NAND gates 658–661, NOR gates 663–666, an operational amplifier 668 having an inverting input 669 and a non-inverting input 670, and resistors 672–674, all connected as shown.

Output amplifier 678 includes transistors 680, 681, resistors 683–685 and an output conductor 687.

Envelope generator 590 operates in the manner described in the above-identified U.S. Pat. No. 4,433,601.

Figure 10:
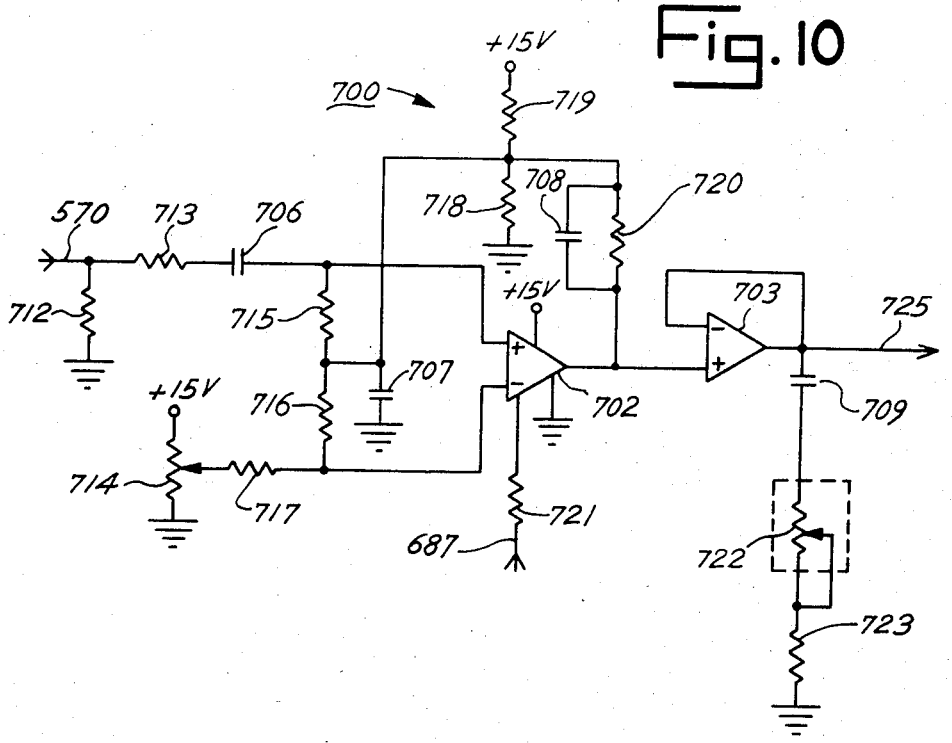
FIG. 10 is an electrical schematic diagram of a preferred form of modulator made in accordance with the present invention.

Referring to FIG. 10, modulator 700 comprises operational amplifiers 702, 703, capacitors 706–709 and resistors 712–723, connected as shown. The modulator modulates the filtered audio signals received from harmonic spectrum adjuster 430 in accordance with the envelope signal received from envelope generator 590 in order to produce one note of a musical accompaniment on an output conductor 725. The note represents one pitch of one instrument or voice. Other pitches and instruments can be represented by additional voice system 252–256.

V. Overall Operation

Figure 11:
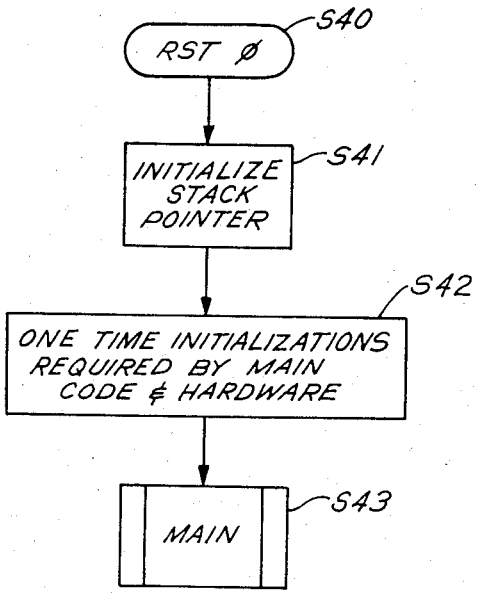

The overall musical instrument is controlled by means of a program stored in ROM 162 which is executed by microprocessor 170. When the instrument is turned on, there are several one-time initialization functions which are performed. Various counters, pointers and variables are initialized by a program called INITLZ. A working area in RAM 166 is set up for stack pointers used by various programs, and a means for swapping these pointers is provided. Each of these initialization procedures is described in steps S40–S43 of the flow chart of FIG. 11.

Figure 12:
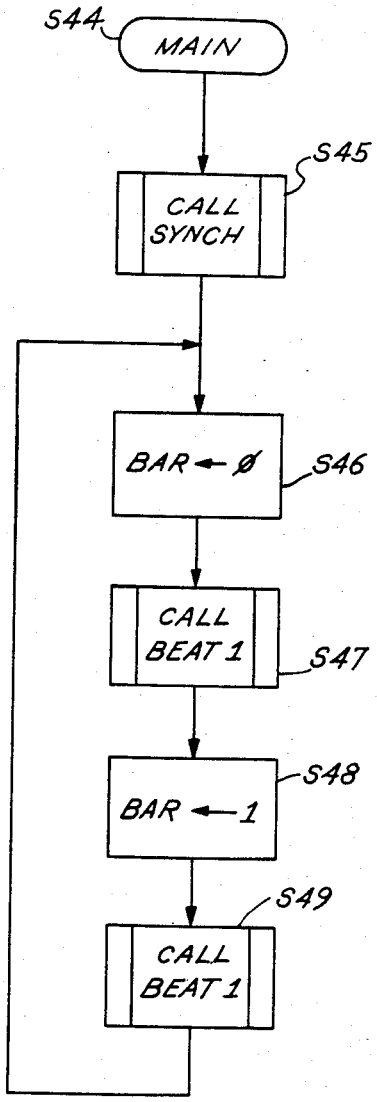

Referring to FIG. 12, the program called Main works on a philosophy of four levels. The outer level responds to the musical style (e.g., bossa nova, big band, etc.) selected by the performer, and arranges the logic for two complete musical bars. The second or bar level arranges for the output of four beats for a normal bar and three beats for a waltz bar. The third or beat level arranges for the output of twelve tempo clock pulses. The fourth or clock pulse level provides a tempo rate according to the selected musical style, locates the proper orchestration and instrument data stored in ROM 164, creates the requisite parameter signals, and outputs the parameter signals to the voice systems in order to create the accompaniment sound.

As shown in step S45 of FIG. 12, the Main program first performs a synchronization function which enables the system and tempo clock 232 to use the same clock pulse as a downbeat. Main waits in a loop until it detects a downbeat condition and then allows continuation of the program. Main then enters an endless loop which is the outer loop for playing the two-bar pattern. The variable BAR is assigned the value 0 in step S46, and the routine BEAT 1 is called in step S47. BEAT 1 plays one bar (three or four beats) which is identified by the contents of the variable BAR. If BAR is assigned the value 0, the first bar is played: if BAR is assigned the value 1, the second bar is played (See steps S48 and S49). The foregoing loop is performed continuously, alternately playing bar 1 and then playing bar 2.

Figure 13:
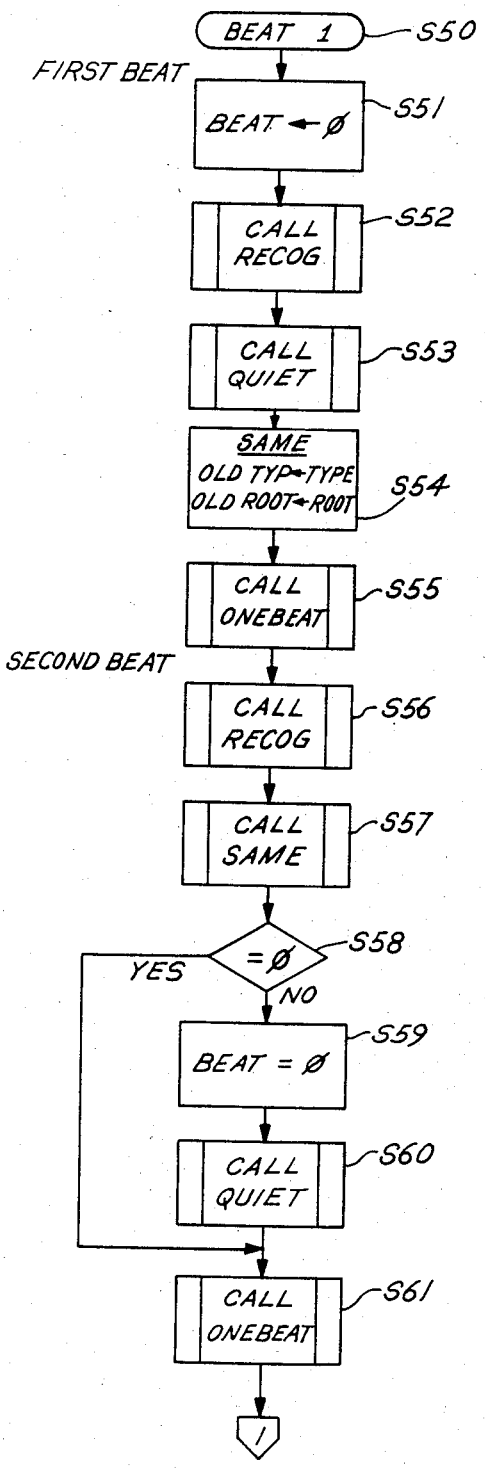

The BEAT 1 routine called by Main is described in the flow charts of FIGS. 13 and 14. Referring to FIG. 13, BEAT 1 determines when chords are recognized (with respect to beats in a bar), determines the response to an invalid chord played by the performer, and determines the dynamic response to a change of chords by the player between the two beat phrases. As described earlier, bars are broken into two parts or phrases. The first of the two phrases always includes two beats, that is beat 1 and beat 2. The second phrase always includes beat 3 and will include beat 4 unless a waltz bar is indicated. The musical bars are broken into these multi-beat phrases so that the proper musical phrasing can be incorporated into the musical accompaniment segments. A unique musical accompaniment segment exists for each musical phrase. If the system recognizes a chord type change between an old phrase and a new phrase, a new unique musical accompaniment is played in the new phrase. However, if a chord type is changed between beats within a phrase, a special operation is required to retain the continuity of the musical phrasing. The musical importance of this operation is described in detail in the above-identified application Ser. No. 307,161.

Referring to the flow charts of FIGS. 13 and 14, during the first beat, the variable BEAT is set to 0 (step S51), and the harmony recognition routine (FIG. 5) is called (step S52) in order to determine the chord type and root desired by the performer. In step S53, the QUIET routine is called to prevent any overhang from a previous musical segment. As previously explained, QUIET enters a number in timer 280 through data bus 154 (FIG. 6) which prevents oscillator 260 from emitting pulses. Overhang may result when a note continues between beats 1 and 2 or between beats 3 and 4. For example, many of the musical segments are written so that notes continue uninterrupted between beats 2 and 3 or between beats 4 and 1. Thus, between these beats, the QUIET routine prevents a conflict between the notes of the old beats and the notes of the new beats. In addition, overhang can result due to a long release decay which extends the envelope generated by generator 590 into the next beat.

If the recognition routine discovers a new chord type or new root, the identification of the new chord type or new root is stored in step S54 by a routine called SAME. The routine determines whether the new chord type and root are the same as the old chord type and root.

After any new chord types or roots have been handled in step S54, the ONE BEAT routine is called in step S55. The ONE BEAT routine arranges for the output of one entire beat (12 tempo clock pulses) and then increments the variable BEAT so that the second beat of the current bar is processed.

During the second beat, the recognition routine again is called in step S56, and any new chord type or root is stored by the SAME routine in step S57. If the chord type and root have not changed between the beats 1 and 2 (i.e., if they are the same), step S58 directs the program to call the one beat routine (step S61). If the chord type or root has changed, step S58 compels the BEAT variable to return to a 0 value and calls the QUIET routine in steps S59 and S60, so that the musical accompaniment for the first beat will be produced during beat 2. As previously explained, this procedure is necessary when the chord type or root has changed between the beats of a 2 beat phrase.

Referring to FIG. 14, during the third beat of the bar, the variable BEAT is incremented to the value 2 in step S62. Steps S63–S66 then follow the same procedure followed by steps S52–S55, in connection with the first beat (FIG. 13). At step S67, the input downbeat routine (INDB) is called to determine whether the third beat completes a 3 beat waltz phrase or whether a fourth beat is required. If the accompaniment is being played in waltz time, the musical phrase is completed, and the program is returned through steps S68 and S69.

In the event a fourth beat is required, the recognition routine is called in step S70, and any change in chord type or root is detected in step S71. In the event that neither the chord type nor root was changed, step S72 jumps the program to step S75 which calls the ONE BEAT routine. If a new chord type or root was detected in step S71, the step S72 compels the BEAT variable to return to a 0 value and calls the QUIET routine in steps S73 and S74, respectively, so that a musical accompaniment for the first beat will be played in step S75. At the conclusion of the fourth beat, the program is returned through step S76.

The ONE BEAT routine called by the BEAT 1 routine (FIGS. 13 and 14) is shown in the flow chart of FIG. 15. In step S79, a variable CLKCNT is set to 0. CLKCNT counts the number of tempo clock pulses and has a value which can vary from 0 to 11, since there are 12 clock pulses in each beat. The rate at which CLKCNT progresses from 0 to 11 changes with style as the output of the tempo clock changes, according to the improvement of the present invention.

Figure 21:
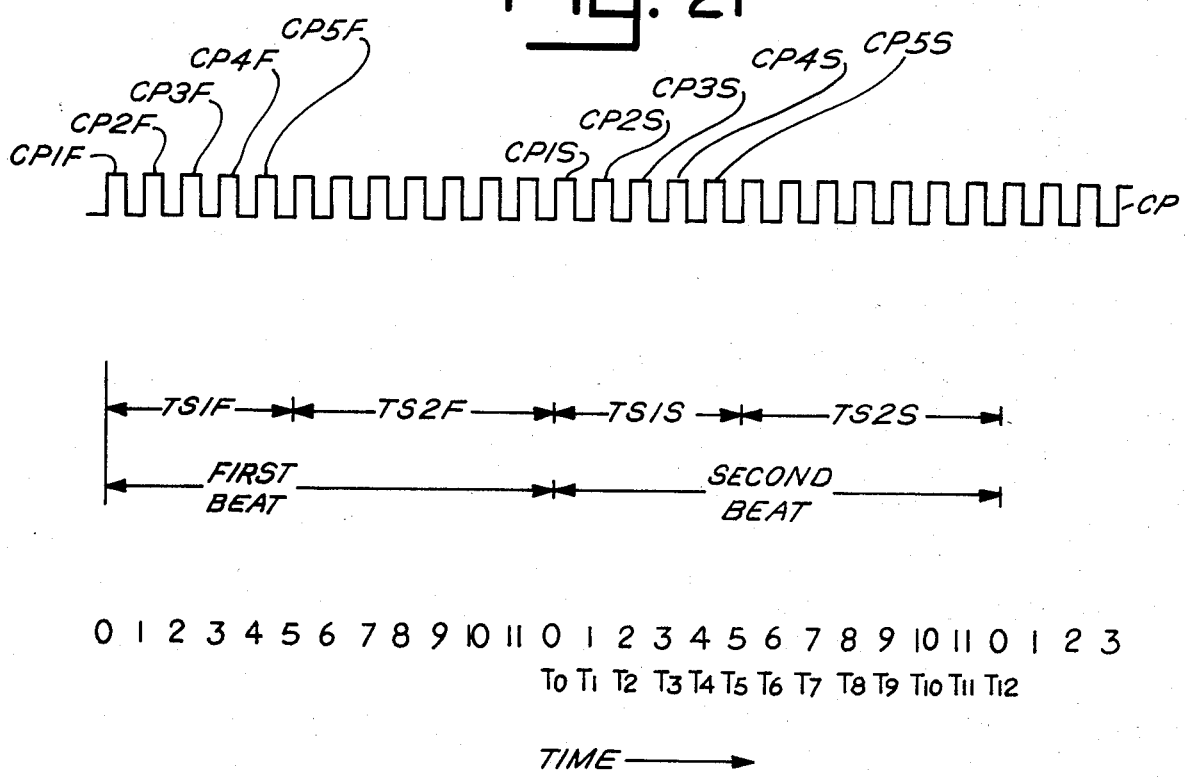
FIG. 21 is a timing diagram illustrating the division of beat into time segments by the tempo clock.

As shown in FIG. 21, the clock pulses CP divide each beat into two time segments. For example, time segments TS1F and TS1S occur during clocks pulses 1–5 (i.e., CP1F–CP5F and CP1S–CP5S) of the first and second beats, respectively. Likewise, time segments TS2F and TS2S occur during the remaining clock pulses 6–11 of the first and second beats, respectively. Each of the other beats in a musical segment is divided in like manner. Returning to FIG. 15, the OUTPUT routine is called in step S80, and the ONE BEAT routine then waits for a tempo clock transition at step S81. When a clock transition is sensed, the CLKCNT variable is incremented in step S82. In step S82A, the WINDOW routine is called to determine whether any changes in harmony occur during time segment TS1. The OUTPUT routine again is called if the end of the beat has not occurred (i.e., if CLKCNT is less than 11). When CLKCNT reaches 11, step S83 causes the variable BEAT to be incremented in step S84, and causes a return to the BEAT 1 routine (FIGS. 13 and 14) in step S85.

Figure 16:
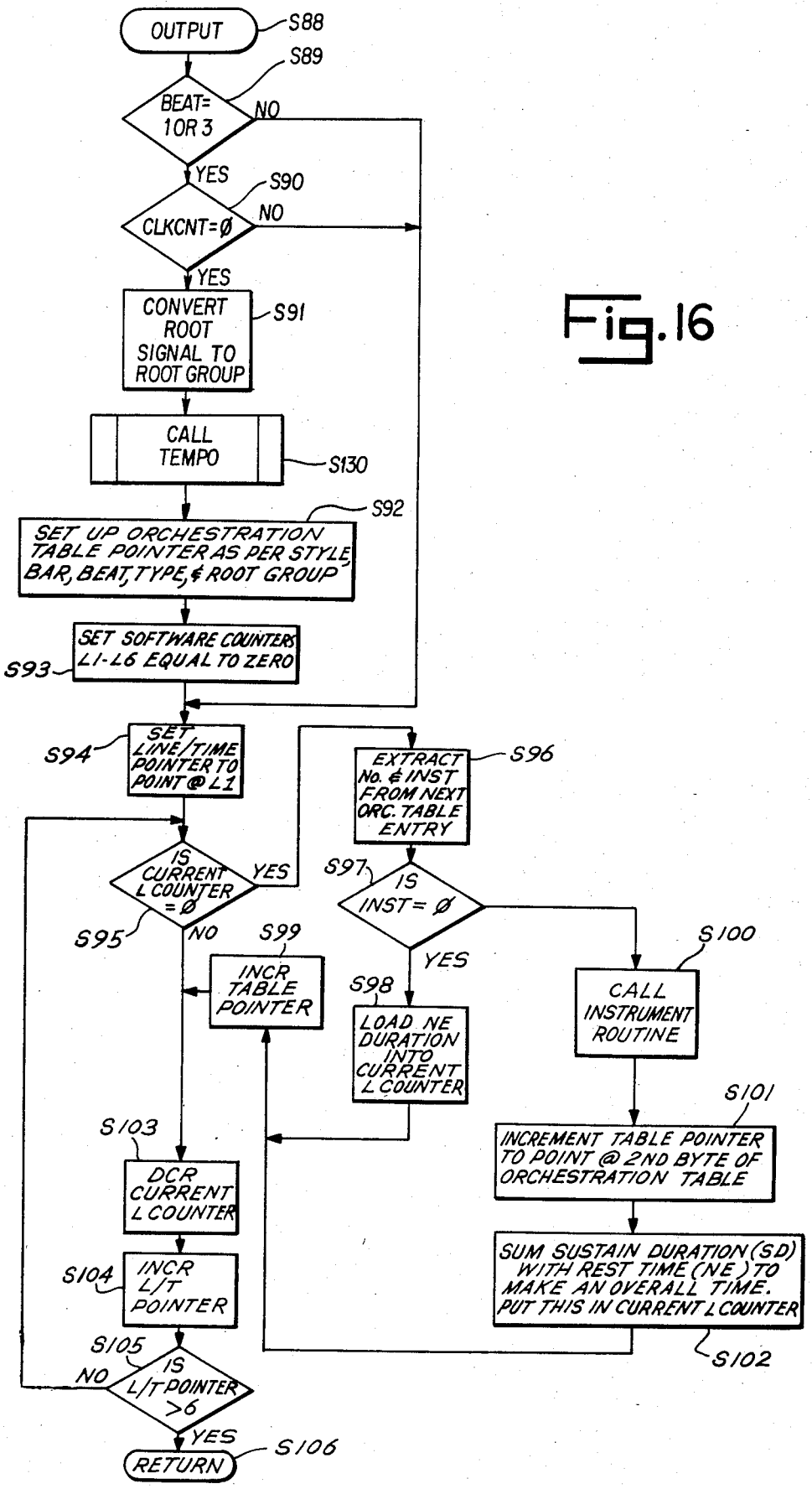

The OUTPUT routine called during the ONE BEAT routine is described in FIG. 16. Assuming the BEAT is 1 or 3 and the tempo clock count is 0 (Steps S89, S90), the chord root signal obtained by the harmony recognition routine (FIG. 5) is converted to one of the root groups previously identified in Step S91. The TEMPO routine is called in Step S130 to update the choice of tempo clock rate as a function of selected musical style and the deviation dialed in by the performer.

Figure 23:
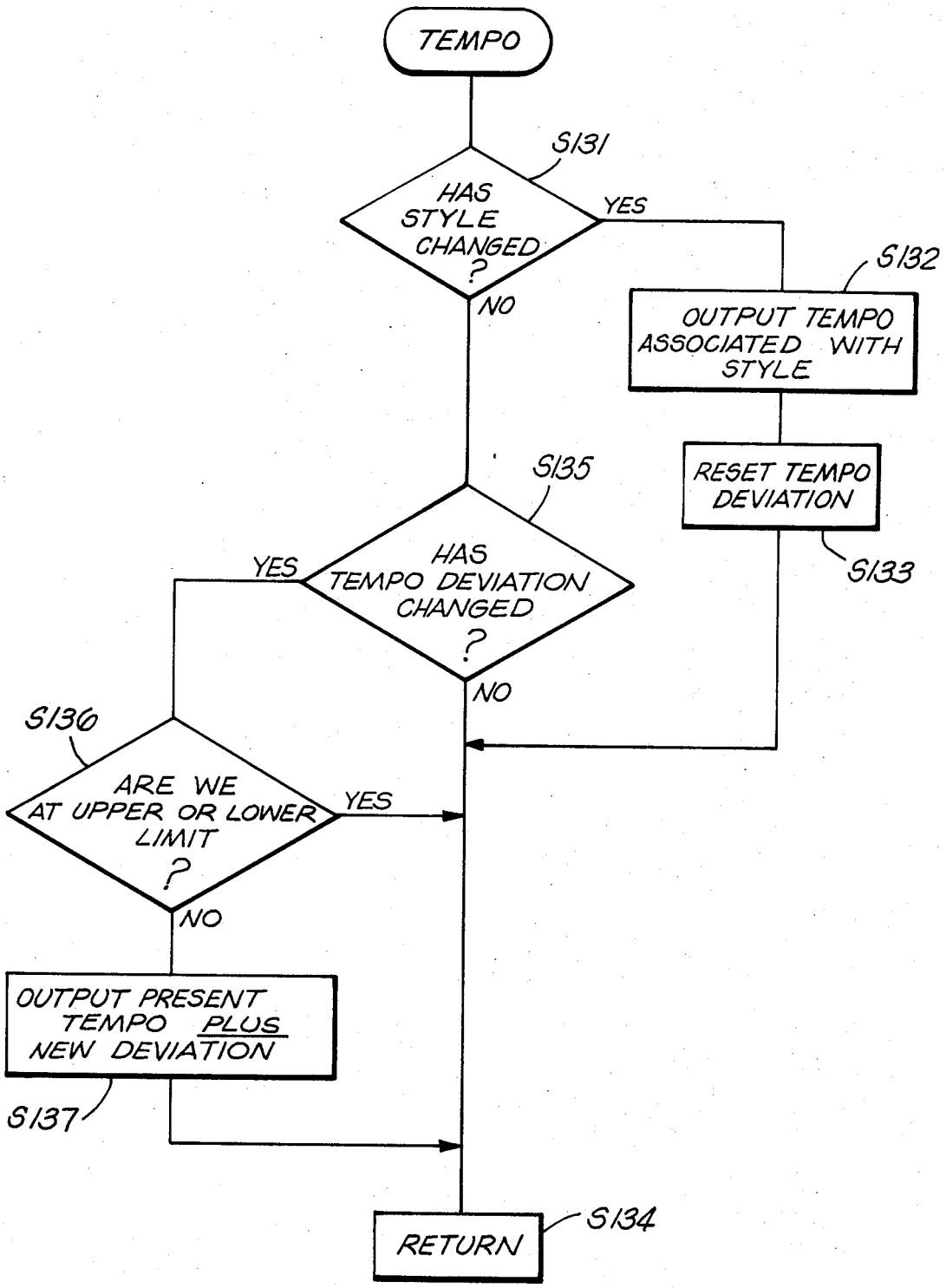
FIG. 23 is a flow chart illustrating the TEMPO routine of the preferred embodiment.

The TEMPO routine is shown in FIG. 23. Pursuant to Step S131, if the selected musical style has changed from the previous time the routine was executed, or if the instrument is executing the routine for the first time since being powered up, a tempo is generated in response to the newly selected style (Step S132) and the tempo deviation is reset (Step S133). The program then returns to Step S130 of the OUTPUT routine through Step S134. In generating a new tempo in Step S132, a divisor associated with the newly selected style is transmitted to the programmable timer 800 (FIG. 22) along the lines $D_0$ through $D_7$ of the data bus 154. The resulting timer output takes the form of clock pulses on the interrupt line at a frequency twelve times the preferred beat rate for the selected style. This output is transmitted to the microprocessor 170 and to the envelope generator 590, as described above.

Returning to Step S131, the program proceeds to Step S135 if the style has not changed from the previous execution of the TEMPO routine. In Step S135, inquiry is made as to whether the tempo deviation has changed since the previous execution of the routine. If it has, the program proceeds to Step S136, in which the tempo is checked against the limits stored in a table associated with the style. If the deviation is at its limit, the program returns to Step S130 of the OUTPUT routine through Step S134, thus leaving the tempo set at its limit. Otherwise, it proceeds through an intermediate Step S137, in which the tempo is altered by the new deviation and outputted for use in producing a musical accompaniment.

Referring now to the steps of the TEMPO routine in more detail, if the style has changed (Step S131), Step S132 outputs a divisor value stored in a memory location associated with the style. The divisor value can be computed for a system with a 100KHZ clock by extracting the integer portion of a number obtained by dividing the quantity (5 * 100 K) by the desired tempo, expressed in beats per minute, where 5 is a constant for conversion. Step S133 initializes the tempo deviation by storing the value zero in a memory location designated for tempo deviation and storing the value of the present position of the tempo deviation input device 235 in a memory location representing the initial position of the device. As expressed herein, the tempo deviation is a signed value expressed in beats per minute. For example, a value of +10 would indicate an increase in the tempo rate of 10 beats per minute and a value of −10 would represent a decrease in tempo of 10 beats per minute. Thus, the initial value of zero represents a deviation of zero beats per minute, permitting the accompaniment to be sounded at the preferred rate for the selected style.

Assuming the style has not changed, Step S131 will have directed the program flow to Step S135. In Step S135, the tempo deviation input device 235 is interrogated by the processor 170 and the value of its present position is stored in a memory location representing the present position of the device. Step S135 inputs this value and subtracts the value stored in an initial position memory location, thus "normalizing" the value of the present position. This normalized value is then compared with the value stored in the tempo deviation memory location. If the values are not the same, the routine proceeds to Step S136, where the normalized value is compared with the upper and lower limits stored in a memory table associated with the selected style. If the deviation would cause a limit to be exceeded, the limit is then stored in the tempo deviation memory location, and the program advances to step 137. If the deviation would not cause the limits to be exceeded, the normalized deviation value is stored in the tempo deviation memory location and the program advances to Step S137. If the deviation is at the upper or lower limit, so that no change in deviation can take place within the limits, the program advances to Step S134. Step S137 outputs a new divisor ("$DIV_2$") resulting from a calculation based upon the stored divisor ("$DIV_1$") associated with the style and the value ("N") stored in the memory location associated with tempo deviation. The new divisor is computed from the stored divisor, the tempo deviation value, and the speed "C" of the clock 802, as follows:

$$DIV_2 = \frac{DIV_1}{1 + \frac{N}{DIV_1} \cdot 5C}$$

(N is expressed in beats per minute.) Care must be taken not to cause truncation errors in computing the new divisor. This calculation will result in a 16 bit value which is outputted to the tempo clock 800 to produce the desired tempo clock rate.

When the routine returns to Step S130 of the OUTPUT routine, it passes through Step S92, wherein a table pointer to the orchestration table in ROM 164 is set up according to the musical style selected by the performer, the bar, the beat, the chord type and the root group.

Figure 20:
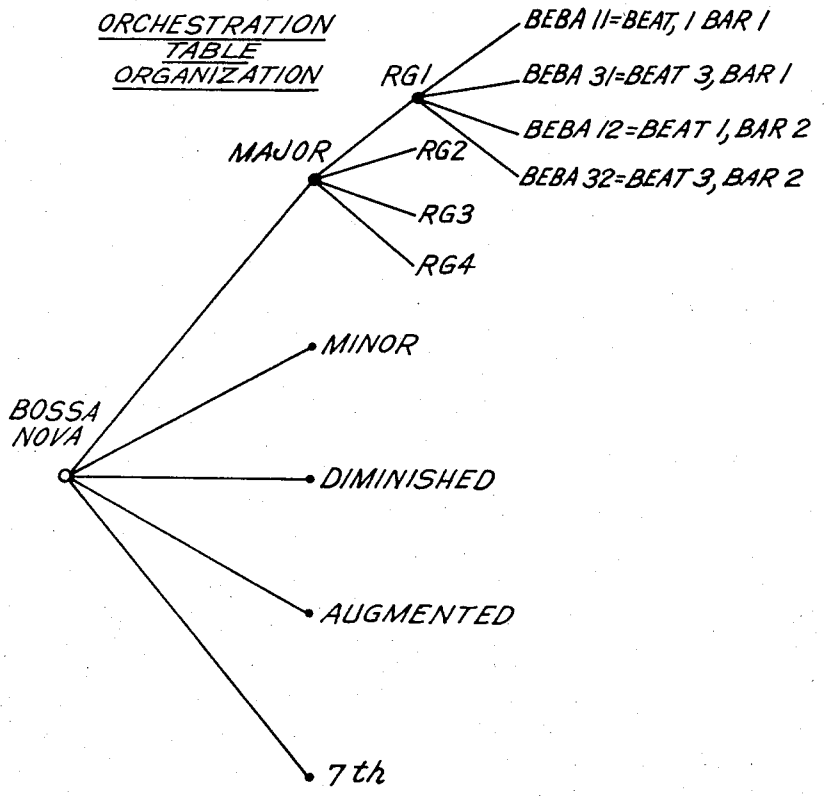
FIG. 20 is a diagram illustrating the organization of the orchestration tables stored in the memory of the preferred embodiment.

The organization of the orchestration table in ROM 164 is illustrated in FIG. 20. As shown in that Figure, each musical style selected by the performer, (such as bossa nova) can point to any one of the five different chord types recognized by the harmony recognition routine (i.e., major, minor diminished, augmented and seventh). In turn, each chord type can point to any one of the four different root groups, and each of the root groups can point to an address identifying any one of four different combinations of beat and bar (i.e., beat 1, bar 1; beat 3, bar 1; beat 1, bar 2; and beat 3, bar 2).

Referring again to FIG. 16, step S93, after the table pointer is set up to point to the proper address of the orchestration table, six software counters L1–L6 corresponding to the six voice systems 251–256 are set equal to 0. In step S94, a line/time pointer is set to point to counter L1. The software counters L1–L6 determine when a new note needs to be produced by one of voice systems 251–256. If the counter has not been decremented to 0, no new note needs to be produced, and the voice system can be ignored by the microprocessor. However, when one of counters L1–L6 is decremented to 0, orchestration signals must be read from ROM 164 in order to produce the next one. The orchestration signals located in ROM 164 are stored in the form illustrated in the following Table 1, in which an "x" indicates a bit of a word:

TABLE 1

| Orchestration Table Entry | | | |
|---|---|---|---|
| 1st Byte | | 2nd Byte | |
| x x x x x | x x x | x x x x | x x x x |
| NO | INST | S.D. | N.E. |

Each orchestration table entry consists of two bytes. The first byte comprises (a) a five bit word NO which is related to the pitch of the note to be produced, and (b) a three bit word INST which defines the type of instrument or voice which the note is to similate. The second byte comprises (a) a four bit word S.D. which defines the duration of the sustain time of the envelope generator and (b) another four bit word N.E., which defines the rest time until the next note of the voice is produced. As previously described in connection with FIG. 9, the S.D. word is transmitted to counter 616 in order to generate the proper envelope for the production of the note.

Returning to FIG. 16, if the current L counter is 0, the NO and INST words are read out of the orchestration table in step S96. According to step S97, if the value of the INST word is 0, a musical rest is indicated, and the value N.E. is loaded into the current L counter in step S98. In step S99, the pointer for the L counters is incremented to point to the next counter, and, in step S103, the current L counter is decremented.

Since the OUTPUT routine is executed once during each tempo clock pulse, the L counters are decremented once during each such clock pulse. As a result, the L counters are kept in synchronism with the tempo clock pulses. After all of the L counters have been serviced during a tempo clock pulse, the program returns to the ONE BEAT routine through steps S105 and S106. If all L counters have not been serviced, the routine returns to step S95 and is repeated with respect to the remaining L counters.

Returning to step S97, if the value of the INST word is not equal to 0, a real instrument is indicated and the instrument routine (INSTRU) is called in step S100. After INSTRU is completed, the orchestration table pointer is moved to the second byte of the orchestration table entry (see Table 1) in step S101. The sum of the sustain duration and rest time (i.e., the sum of words S.D. and N.E.) then is loaded into the current L counter in step S102 in order to define the next time when the voice system corresponding to the current L counter needs service. The table pointers then are incremented in step S99, and the routine follows the previously described steps S103–S106.

Figure 19:
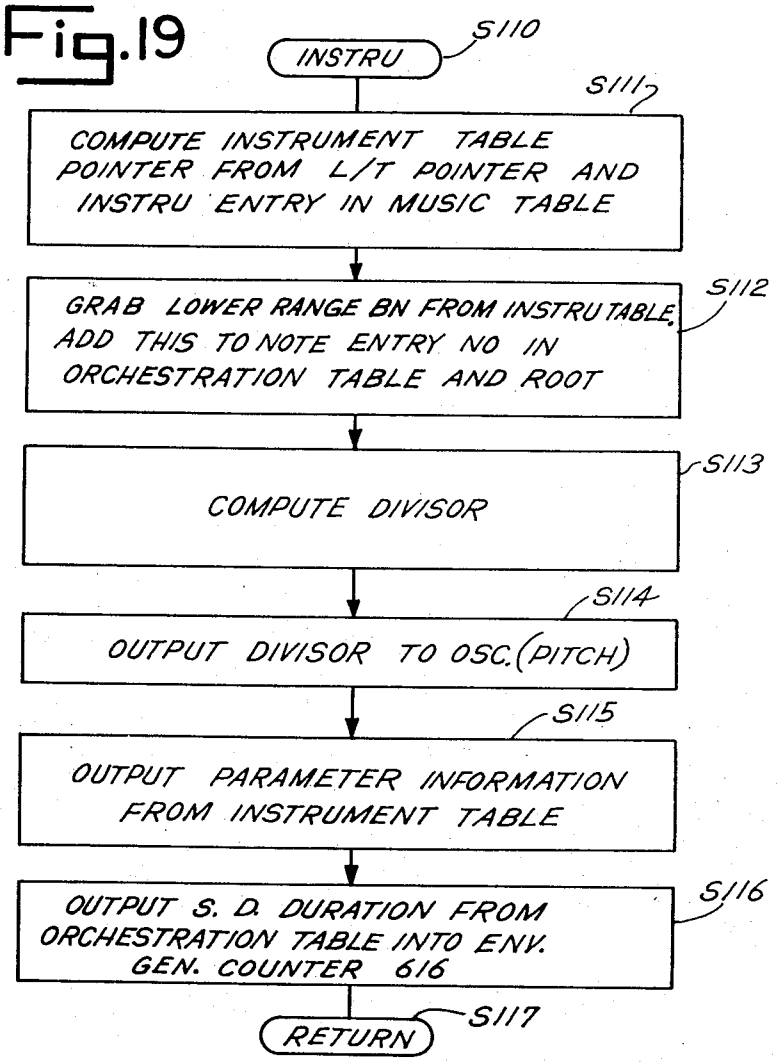

Referring to FIG. 19, when the instrument routine (INSTRU) is called, a pointer to the proper entry in the instrument table stored in ROM 164 is calculated from the current value of the line/time pointer (step S94) and from the INST word stored in the orchestration table (Table 1) (step S111). The instrument signals located in ROM 164 are stored in the form illustrated in the following Table 2:

TABLE 2

| INSTRUMENT TABLE ENTRY | | | | |
|---|---|---|---|---|
| 1 | x x x x x x x x<br>Base Number | BN | (0–95, 8 Octaves) | |
| 2 | x x x<br>Attack (A) | xxx<br>Percusive<br>Decay (PD) | xxx<br>Sustain<br>Level (S) | x<br><br>— |
| 3 | x x x<br>Release<br>Decay (D) | x x<br>Percusive<br>Release (PR) | x x x<br><br>— | |
| 4 | x x x<br>Pulse<br>Width<br>(latch 460) | x<br>"WAH"<br>On<br>(And Gate<br>467) | x<br>Vib.<br>Mod.<br>On<br>(And Gate<br>464) | x x x<br><br><br><br>— |
| 5 | x x x x x x x x<br>Volume Control (To Filter Latch 567) | | | |
| 6 | x x x x x x x x<br>Portamento and Vibrato Control (To Latch 314) | | | |
| 7 | x x x x x x x x<br>Portamento Rare (To Latch 362) | | | |
| 8 | x x x x x x x x<br>Filter characteristic (To Filter Latch 566) | | | |

Each entry consists of eight words, and each word has 8 bits. Once the proper entry in the instrument table is addressed by the calculated pointer, a base number BN is read out of word 1 of the entry. BN defines the Lowest pitch which can be played by an instrument or voice. In step S112, the microprocessor sums BN+NO(from the orchestration table)+the value of the root (from counter 228, FIG. 3) to obtain a value P. In steps S113 and S114, the value P is used to compute the divisor number which is read out to timer 280 in oscillator 260 on data bus 154. As previously described, the divisor number determines the pitch of the note to be produced by one of voice systems 251–256. In step S115, the parameter signals stored as words 2–8 in the instrument table entry are transmitted over bus 154 to the appropriate latches of the proper voice system. A detailed description of words 2–8 is found in the above-identified U.S. Pat. No. 4,433,601.

Referring again to FIG. 19, in step S116, the value SD is read from the orchestration table into counter 616 of the envelope generator (FIG. 9) in order to determine the sustain time duration of the note. The program then is returned to the output routine through step S117. The parameter signals control the designated voice system so that a tone signal having the proper pitch and harmonic spectrum is generated. The tone signals from each of the voice systems are summed and amplified in amplifier 77 and are converted to sound waves by transducer 79.

Figure 17:
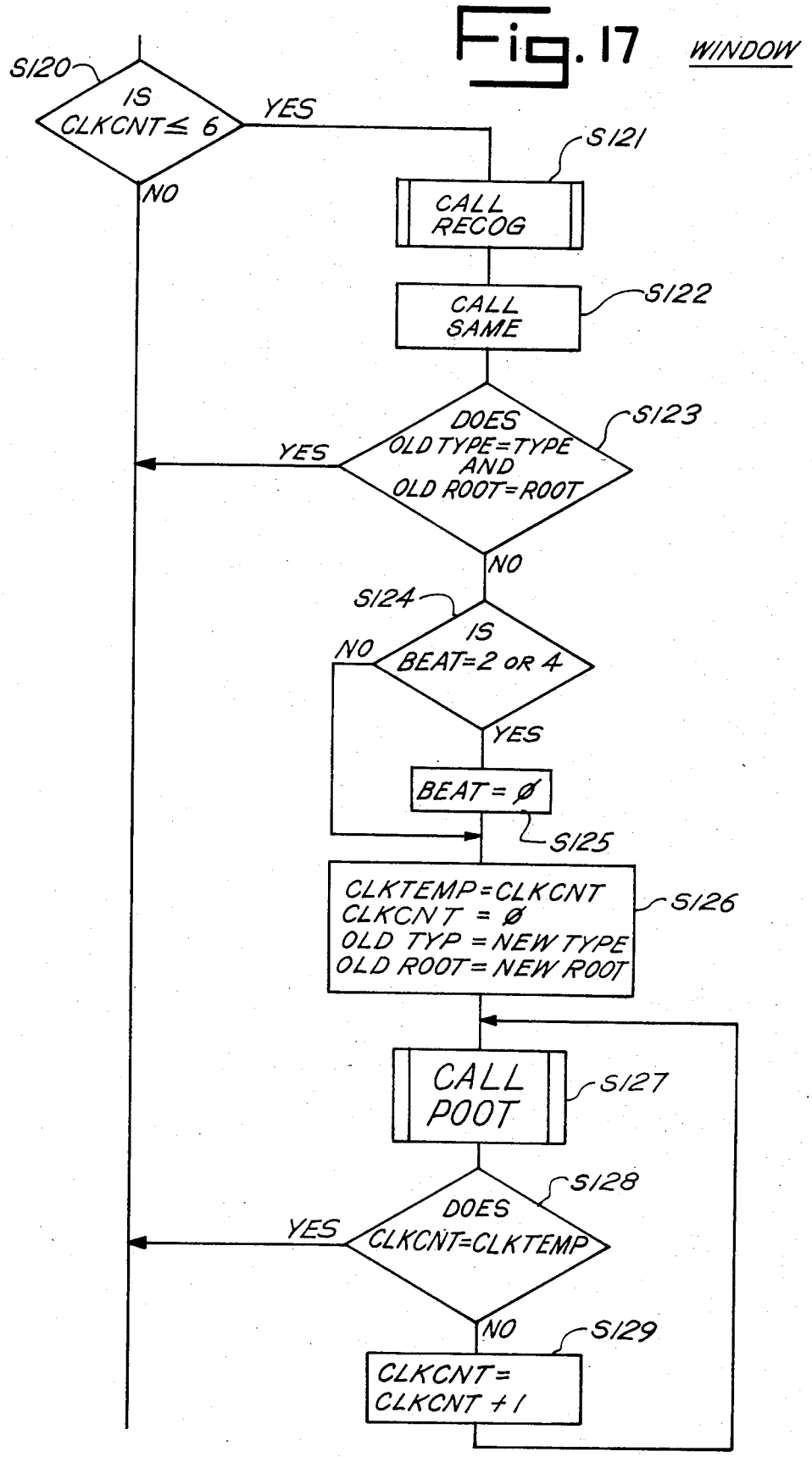

The WINDOW routine referred to in FIG. 15 is described in detail in FIG. 17. In step S120, the routine determines whether the CLKCNT is equal to or less than 6 (i.e., whether the instrument is in time segment TS1 of FIG. 21). If so, the RECOG and SAME routines are called in steps S121 and S122. These routines were earlier described in connection with steps S52 and S54. In step S123, the WINDOW routine determines whether the previously-selected harmony has remained the same. If so, the routine exits to step S83 of the ONE BEAT routine (FIG. 15). If the performer has changed the harmony, steps S124 and S125 change the value of variable BEAT to 0 if the instrument is in the second or fourth beat of the measure. (In the second and fourth beats of the measure, the variable BEAT has the values 1 and 3, respectively). In step S126, the value of variable CLKCNT is stored as value CLKTEMP, CLKCNT is set equal to 0, and the variables OLD TYPE and OLD ROOT are set equal to the new type and root values obtained in step S121.

The routine POOT is called in step S127 in order to interrogate the music signals corresponding to the new type and root. (These signals were described in Tables 1 and 2.) POOT locates the new music signals appropriate for use subsequent to the current CLKCNT and synchronizes the new music signals with the tempo clock. Steps S128 and S129 cause POOT to be repeatedly executed until CLKCNT=CLKTEMP. At the time the addressing of the music signals is synchronized with the clock pulses and CLKCNT value, and the addressed music signals can be used by the OUTPUT routine. POOT then exits through the WINDOW routine to step S83 of the ONE BEAT routine (FIG. 15).

Figure 18:
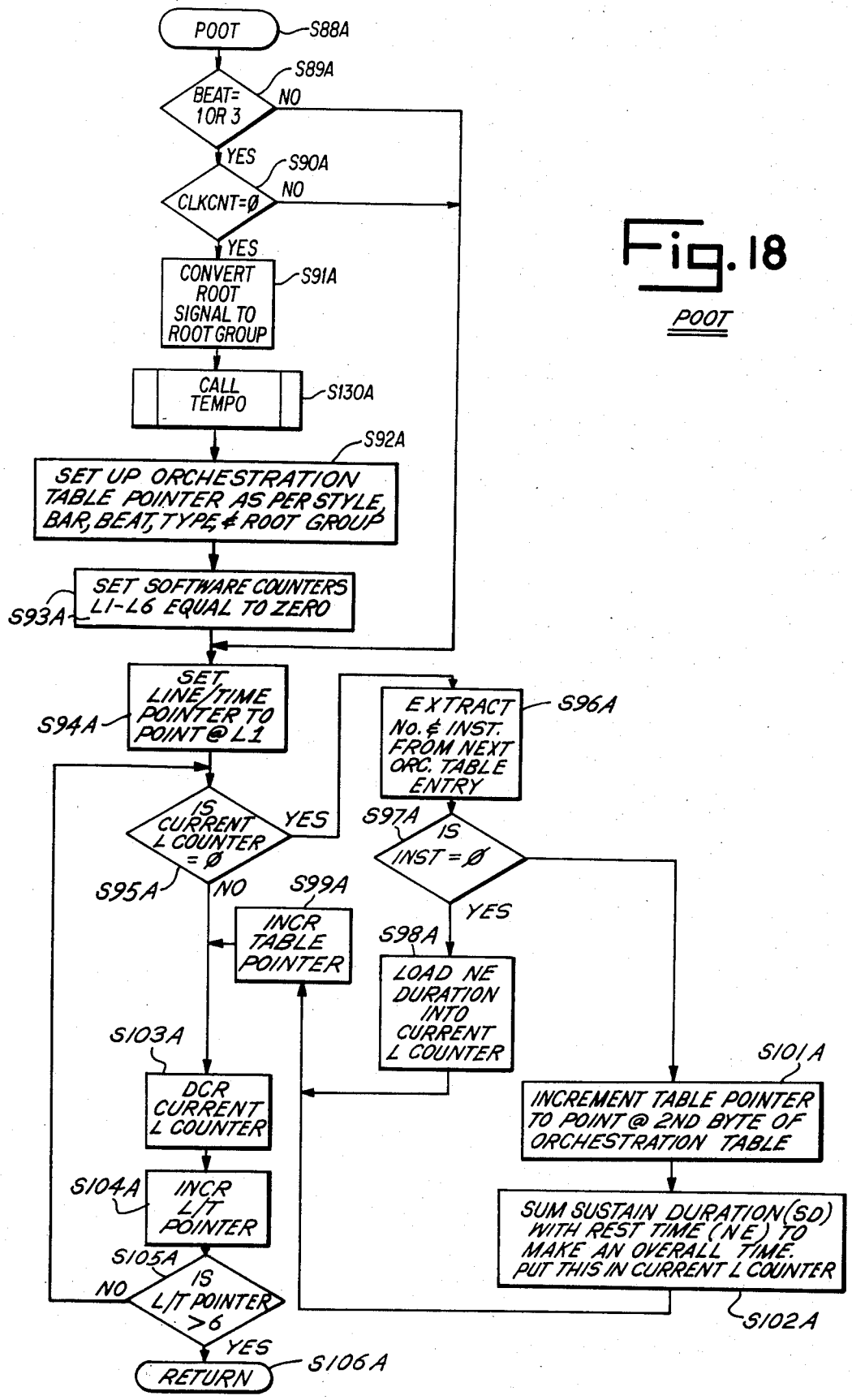

FIG. 18 illustrates the POOT routine. POOT is identical to OUTPUT, except that POOT does not call the INSTRUMENT routine. Like OUTPUT, POOT calls the TEMPO routine of FIG. 23, updating the tempo rate and deviation at the appropriate times according to the improvement of the present invention. In FIG. 18, the like steps of POOT and OUTPUT have been given like numbers, except that the POOT steps bear the suffix "A". POOT can be understood with reference to the preceding description of OUTPUT (FIG. 16). As shown in FIG. 18, POOT addresses the music signals stored in ROM like OUTPUT, but POOT operates at a much faster rate than OUTPUT. As previously explained, OUTPUT is executed only once during each clock pulse CP. However, POOT is executed as rapidly as possible within the WINDOW routine until CLKCNT=CLKTEMP. Thus, POOT is typically executed several times within a small fraction of the period of one clock pulse.

The operation of WINDOW and POOT can best be explained by an example. Referring to FIG. 21, assume that the instrument is playing a musical segment based on a C major chord during time segment TS1F (FIG. 21). During time segment TS2F, the performer lifts his hand from the keyboard and prepares to play in A minor chord. The instrument continues to play a musical segment in C major harmony even though the performer is no longer depressing keys. This is an important feature which facilitates chord changes by unskilled players. As shown in FIG. 17, since CLKCNT is 6 or greater during time segment TS2F, the keyboard is not monitored by RECOG and POOT is not called, so that the harmony remains the same. As shown in FIGS. 15 and 16, OUTPUT addresses the memory once during each CLKCNT increment in order to service the line/time pointers and to keep parameter signals flowing to the output circuits as needed. Thus, OUTPUT addresses the memory and generates the parameter signals in synchronism with the clock pulses at a rate determined by the clock pulses.

Assume the performer intends to strike an A minor chord at time T0 (FIG. 21) at the beginning of the second beat, but is late and does not strike the A minor chord until time T2 (i.e., he plays behind the beat). During time periods T0 to T2, the harmony is undefined by the performer, and the instrument will generate a musical segment based on a harmony assigned by the instrument program instructions. This harmony probably will sound badly with the melody being played by the performer which is intended for A minor harmony.

Within a few microseconds after the A minor chord is struck at time T2, the ONE BEAT routine is executed (FIG. 15) and causes the WINDOW routine (FIG. 17) to replace the C major root and type with the A minor root and type (steps S123 and S126). POOT is called in step S127 and is used for interrogating the stored set of musical signals corresponding with A minor harmony and for locating within that set the signals appropriate for outputting subsequent to time T2 in the second beat (FIG. 21). The locating is done by rapidly addressing the memory and servicing the line/time pointers under the control of POOT at a rate much more rapid than the same addressing and servicing is performed by OUTPUT. Within a few microseconds, POOT will bring the line/time pointers, table pointers and counters into synchronism with the current CLKCNT so that the musical segment can thereafter continue under the control of OUTPUT in the changed A minor harmony. The instrument then continues to produce a musical segment in A minor harmony for the remainder of the second beat. The rapid updating of output information by POOT during time segment TS1 is an important feature which enables an unskilled performer to hear a substantial portion of a beat in the intended harmony, even though the performer did not play that harmony at the beginning of the beat.

Operation of the instrument to produce musical accompaniment is commenced by selection of a style with one of the switches 142 through 146 (FIG. 1), initialization of all table pointers to point to the initial data entries and playing of the instrument by a performer. A suitable preferred clock output and a range of permissible deviation from that output are provided in response to the selection of a musical style. The output has a frequency of 12 times a beat rate which is considered optimal for the selected style. The output is applied to the interrupt line 157 to trigger a plurality of cycles of the "ONE BEAT" routine of FIG. 15. Each pulse or clock transition calls the OUTPUT routine to play any note or other musical event corresponding to the next entry of the portion of the orchestration table which is appropriate for the selected harmony. If the tempo deviation is not changed, the accompaniment will continue to be played at the tempo considered optimum for the selected style of music. However, the performer can deviate from the optimum tempo within a preselected range by manually adjusting the tempo deviation. For example, in a "disco" style the preferred tempo rate might be 124 beats per minute, with the permissible range of 110 to 135 beats per minute. The accompaniment would then be played at 124 beats per minute upon selection of the disco style, until the deviation knob 235 was adjusted or the style was changed.

If the style is changed or the tempo deviation is changed at a time when the beat is 1 or 3 and the clock count is equal to zero, the TEMPO routine will be called by the OUTPUT routine to alter the tempo rate of the accompaniment. Likewise, any change of style or tempo deviation coincidental with a change of chord type or root during the first time segment (TS1) of either beat 1 or beat 3 will be recognized by the TEMPO routine in the context of the POOT routine. The tempo and tempo deviation are thus kept current during the operation of the musical instrument, to the extent that it is musically appropriate to do so. It will, of course, be understood that the software described herein can be modified to call the TEMPO routine more often. For example, TEMPO may be called each time output is executed.

Those skilled in the art will recognize that each of the foregoing features can be implemented by choosing proper values for the orchestration and instrument table entries, by placing the entries in an appropriate time sequential order in the memory so that they are available for access when the desired musical notes need to be generated, and by choosing values for the inputs to the programmable timer 800 of FIG. 22 for the purpose of producing appropriate tempo clock rates and ranges of permissible deviation for the various musical styles.

A detailed program listing, as well as exemplary entries for the orchestration and instrument tables, was supplied with U.S. Pat. No. 4,433,601. Those skilled in the art can easily adapt that program listing to implement the flow charts described above.

Those skilled in the art will recognize that the preferred embodiment may be altered and modified without departing from the true spirit and scope of the invention as defined in the appended claims.

What is claimed is:

1. In a method for providing musical accompaniment in different musical styles to the playing of an instrument, upon selection of one of the styles, the improvement comprising the steps, accomplished by the instrument itself, of:

providing, in response to the selection of a musical style, a tempo rate characteristic of the style by generating a timing signal of preselected frequency, the frequency of the timing signal being a preselected multiple of the characteristic tempo rate and at least twelve times said tempo rate;

providing an accompaniment comprising a plurality of musical notes in dynamic response to the playing of the instrument; and sounding the musical notes of the accompaniment at said tempo rate in response to the timing signal.

2. In a method for providing musical accompaniment in different musical styles to the playing of an instrument, upon selection of one of the styles, the improvement comprising the steps, accomplished by the instrument itself, of:

providing, in response to the selection of a musical style, a tempo rate characteristic of the style by generating a timing signal of preselected frequency, the frequency of the timing signal being a preselected multiple of the characteristic tempo rate;

providing an accompaniment comprising a plurality of musical notes in dynamic response to the playing of the instrument;

sounding the musical notes of the accompaniment at said tempo rate in response to the timing signal;

establishing a range of permissible deviation from the frequency of the timing signal in response to the selection of a musical style; and enabling a performer to alter the frequency of the timing signal within the range.

3. The method of claim 2 wherein:

the frequency of the timing signal is manually adjustable within the range.

4. The method of claim 2 which is further characterized by the step of:

resetting the deviation in frequency to zero in response to a change in the selected style.

5. In a method for providing musical accompaniment in different musical styles to the playing of an instrument, upon selection of one of the styles, the improvement comprising the steps, accomplished by the instrument itself, of:

providing, in response to the selection of a musical style, a range of acceptable tempo rates characteristic of the style;

permitting a performer to choose a tempo rate within the range;

providing an accompaniment in dynamic response to playing of the instrument; and sounding the accompaniment at the chosen tempo rate.

6. The method of claim 5 wherein:

the performer can alter the tempo rate only within said range.

7. The method of claim 6 wherein the step of sounding the accompaniment comprises:

generating an appropriate timing signal having a frequency which is a preselected multiple of the chosen tempo rate; and sounding a plurality of musical notes in response to the timing signal.

8. The method of claim 7 wherein:

the frequency of the timing signal is at least 12 times the tempo rate.

9. In a method for providing musical accompaniment in different musical styles to the playing of an instrument, upon selection of one of the styles, the improvement comprising the steps, accomplished by the instrument itself, of:

providing, in response to the selection of a musical style, a tempo rate characteristic of the style;

establishing a range of permissible deviation of the tempo rate for the selected musical style;

enabling a performer to alter the tempo rate within the range;

providing an accompaniment in dynamic response to playing of the instrument; and sounding the accompaniment at the resulting tempo rate.

10. The method of claim 9 which is further characterized by:

resetting the deviation of the tempo rate to zero in response to a change in the selected style.

11. The method of claim 9 wherein:

the tempo rate is provided by generating a timing signal having a preselected frequency which is a multiple of the tempo rate; and the accompaniment comprises a plurality of musical notes sounded in response to the timing signal.

12. The method of claim 11 wherein:

the performer alters the tempo rate by changing the frequency of the timing signal within a preselected range of frequencies.

13. In an apparatus for providing musical accompaniment in different musical styles to the playing of an instrument, upon selection of one of the styles, the improvement comprising:

means for providing a characteristic tempo rate in response to the selection of a musical style, including means for generating a timing signal of preselected frequency, the frequency of the timing signal being a preselected multiple of the characteristic tempo rate and at least twelve times said tempo rate;

means for providing an accompaniment comprising a plurality of musical notes in dynamic response to playing of the instrument; and means for sounding the musical notes of the accompaniment at said tempo rate in response to the timing signal.

14. In an apparatus for providing musical accompaniment in different musical styles to the playing of an instrument, upon selection of one of the styles, the improvement comprising:

means for providing a characteristic tempo rate in response to the selection of a musical style, including means for generating a timing signal of preselected frequency, the frequency of the timing signal being a preselected multiple of the characteristic tempo rate;

means for providing an accompaniment in dynamic response to playing of the instrument;

means for sounding the accompaniment at said tempo rate in response to the timing signal;

means for establishing a range of permissible deviation from the frequency of the timing signal in response to the selection of the musical style; and means for altering the frequency of the timing signal within the range.

15. The apparatus of claim 14, further comprising:

means for resetting the deviation in frequency of the timing signal to zero in response to a change in the selected style.

16. In an apparatus for providing musical accompaniment in different musical styles to the playing of an instrument, upon selection of one of the styles, the improvement comprising:

means for providing a range of acceptable tempo rates in response to the selection of a musical style;

means for enabling a performer to select a tempo rate within the range;

means for providing an accompaniment in dynamic response to playing of the instrument; and means for sounding the accompaniment at the chosen tempo rate.

17. The apparatus of claim 16 wherein the sounding means comprises:

means for generating a timing signal having a frequency which is a preselected multiple of the chosen tempo; and means for sounding a plurality of musical notes in response to the timing signal.

18. In an apparatus for providing musical accompaniment in different musical styles to the playing of an instrument, upon selection of one of the styles, the improvement comprising:

means for providing a characteristic tempo rate in response to the selection of a musical style;

means for establishing a range of permissible deviation of the tempo rate for the selected musical style;

means for altering the tempo rate within the range;

means for providing an accompaniment in dynamic response to playing of the instrument; and means for sounding the accompaniment at the resulting tempo rate.

19. The apparatus of claim 18, further comprising:

means for resetting the deviation of the tempo rate to zero in response to a change in the selected style.

20. The apparatus of claim 18 wherein:

the means for providing a tempo rate comprises means for generating a timing signal having a preselected frequency which is a multiple of the tempo rate; and the means for sounding the accompaniment comprises means for sounding a plurality of musical notes in response to the timing signal.

21. The apparatus of claim 20 wherein:

the means for altering the tempo rate comprises means for changing the frequency of the timing signal within a preselected range of frequencies.

* * * * *